US010275974B2

(12) United States Patent
Koga et al.

(10) Patent No.: US 10,275,974 B2
(45) Date of Patent: Apr. 30, 2019

(54) PAPER SHEET HANDLING APPARATUS

(71) Applicant: GLORY LTD., Himeji-shi, Hyogo (JP)

(72) Inventors: Fumiaki Koga, Himeji (JP); Akira Hibino, Himeji (JP); Osamu Uehara, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/662,320

(22) Filed: Jul. 28, 2017

(65) Prior Publication Data

US 2018/0033230 A1 Feb. 1, 2018

(30) Foreign Application Priority Data

Jul. 28, 2016 (JP) ..... 2016-148836

(51) Int. Cl.
*G07D 7/04* (2016.01)
*G07D 11/00* (2019.01)
(Continued)

(52) U.S. Cl.
CPC ..... *G07D 11/50* (2019.01); *B65H 29/22* (2013.01); *G07D 7/164* (2013.01); *G07D 11/10* (2019.01);
(Continued)

(58) Field of Classification Search
CPC ..... G07D 11/0003; G07D 11/0033; G07D 11/0048; G07D 11/0081; G07D 11/0084
(Continued)

(56) References Cited

U.S. PATENT DOCUMENTS 4,275,874 A * 6/1981 DiBlasio ..... B65H 29/40 271/178
9,087,425 B2 * 7/2015 Park ..... G07D 7/128
(Continued)

FOREIGN PATENT DOCUMENTS

EP 1 393 823 A2 3/2004
EP 1393823 A2 * 3/2004 ..... B07C 3/00
(Continued)

OTHER PUBLICATIONS

European Search Report (Application No. 17182382.6) (7 pages—dated Dec. 15, 2017).
(Continued)

*Primary Examiner* — Terrell H Matthews
(74) *Attorney, Agent, or Firm* — Renner, Kenner, Greive, Bobak, Taylor & Weber

(57) ABSTRACT

The paper sheet handling apparatus includes a base module and an extension module connected to the base module. The base module includes a feeding unit, a first transport unit, a recognition unit that recognizes the paper sheet, first-type stacking units arranged along a first direction for stacking a paper sheet and having an opening to remove the stacked paper sheet, and a control unit that controls transport of the paper sheet based on a recognition result obtained in the recognition unit. The extension module includes a second transport unit that transports inside the extension module a paper sheet discharged from the base module by the first transport unit, and second-type stacking units arranged along a second direction different from the first direction and having an opening to remove the stacked paper sheet. The control unit controls the first-type stacking unit and the second-type stacking unit to sort and stack the paper sheet.

19 Claims, 13 Drawing Sheets

(51) Int. Cl.

| | |
|---|---|
| ***G07D 11/50*** | (2019.01) |
| ***G07D 11/18*** | (2019.01) |
| ***G07D 11/235*** | (2019.01) |
| ***B65H 29/22*** | (2006.01) |
| ***G07D 7/164*** | (2016.01) |
| ***G07D 11/10*** | (2019.01) |
| ***G07D 11/40*** | (2019.01) |

(52) U.S. Cl.
CPC ..... *G07D 11/18* (2019.01); *G07D 11/235* (2019.01); *G07D 11/40* (2019.01); *B65H 2701/1912* (2013.01); *G07D 7/04* (2013.01)

(58) Field of Classification Search
USPC ..... 209/534
See application file for complete search history.

(56) References Cited

U.S. PATENT DOCUMENTS

| | | | | |
|---|---|---|---|---|
| 9,586,784 | B2 * | 3/2017 | Hodatsu | G07D 11/00 |
| 9,852,571 | B2 * | 12/2017 | Hodatsu | G07D 11/0003 |
| 2006/0163027 | A1 * | 7/2006 | Hobmeier | B65H 29/006 194/207 |
| 2010/0207319 | A1 * | 8/2010 | Sato | B65H 29/40 271/145 |
| 2011/0011778 | A1 * | 1/2011 | Inoue | G07D 11/0012 209/534 |
| 2011/0243634 | A1 | 10/2011 | Kagami et al. | |
| 2012/0279173 | A1 | 11/2012 | Sakoguchi et al. | |
| 2016/0060070 | A1 | 3/2016 | Hodatsu | |
| 2017/0256113 | A1 * | 9/2017 | Asada | G07D 11/0054 |

FOREIGN PATENT DOCUMENTS

| | | | | |
|---|---|---|---|---|
| EP | 2 615 588 | A1 | 7/2013 | |
| EP | 2615588 | A1 * | 7/2013 | G07D 11/0003 |
| EP | 2 669 869 | A2 | 12/2013 | |
| JP | 4358001 | B2 | 8/2009 | |
| WO | WO 2012/150029 | A1 | 11/2012 | |
| WO | WO-2012150029 | A1 * | 11/2012 | G07D 11/0081 |

OTHER PUBLICATIONS

Russian Office Action with English Translation (Application No. 2017126904) (8 pages—dated Jul. 5, 2018).

* cited by examiner

PAPER SHEET HANDLING APPARATUS

BACKGROUND OF THE INVENTION

1. Field of the Invention

The present invention relates to a paper sheet handling apparatus that recognizes types of paper sheet and sorts and stacks the paper sheets into one of a plurality of stacking units accordingly.

2. Description of the Related Art

A paper sheet handling apparatus that recognizes types of paper sheet and sorts and stacks the paper sheets into one of a plurality of stacking units accordingly is known in the art. For example, in a financial institution, such as a bank, a banknote handling apparatus that performs recognition and counting of banknotes is used. The banknote handling apparatus receives banknotes one by one and recognizes a characteristic of the banknote, such as denomination, authenticity, and fitness. By using a banknote handling apparatus having a plurality of stacking units, the banknotes can be sorted and stacked in each of the stacking units according to the characteristic of the banknote, based on the recognition result of the banknote.

For example, a paper sheet handling apparatus having six stacking units is disclosed in Japanese Patent No. 4358001. Each of the stacking units has an opening. A user of the apparatus can take out banknotes stacked in any of the stacking units through this opening. For example, the user can use such a paper sheet handling apparatus if the user desires to sort mixed denomination banknotes, which is a bundle of banknotes in which banknotes of various denominations are present in a mixed state, according to denomination. By processing the mixed denomination banknotes in such a paper sheet handling apparatus, the banknotes are recognized one by one and stacked in an appropriate stacking unit according to denomination. The user can take out the banknotes from the stacking units and obtain the banknotes that have been sorted.

However, a banknote handling apparatus that has a large number of stacking units arranged side by side in a horizontal direction requires a large installation area. Moreover, a horizontal distance between the stacking units at either end of the apparatus is great, such that the user must move a relatively large distance when removing banknotes from the stacking units. Furthermore, it is difficult for the user to check whether a banknote has been stacked in a stacking unit that is located away from the user. The apparatus is not user friendly.

SUMMARY OF THE INVENTION

The present invention is made to address the drawbacks of conventional technology. One object of the present invention is to provide a paper sheet handling apparatus having a large number of stacking units, but that requires a smaller installation area, and that is easy to use.

To solve the above problems and to achieve the above object, a paper sheet handling apparatus according to the present invention includes a base module and an extension module connected to the base module. The base module includes a feeding unit that receives a paper sheet inside the base module; a first transport unit that transports the paper sheet fed by the feeding unit; a recognition unit that recognizes the paper sheet transported by the first transport unit; a plurality of first-type stacking units that stack paper sheets; and a control unit that controls transport of the paper sheet based on a recognition result obtained by the recognition unit. The plurality of first-type stacking units are arranged along a first direction. Each of the plurality of first-type stacking units has an opening through which a stacked banknote can be taken out. The extension module includes a second transport unit that advances a paper sheet discharged from the base module by the first transport unit; and a plurality of second-type stacking units that stacks paper sheets. The plurality of second-type stacking units are arranged along a second direction that is different from the first direction. Each of the plurality of second-type stacking units has an opening through which a stacked banknote can be taken out. The control unit transports the paper sheet to at least one of the first-type stacking unit and the second-type stacking unit.

The above and other objects, features, advantages and technical and industrial significance of this invention will be better understood by reading the following detailed description of presently preferred embodiments of the invention, when considered with respect to the accompanying drawings.

EMBODIMENTS

Exemplary embodiments of a paper sheet handling apparatus according to the present invention are explained below in detail with reference to the accompanying drawings. Although there is no limitation on the types of paper sheet that can be handled by the paper sheet handling apparatus, the embodiments have been explained below by using an example of a banknote handling apparatus that handles banknotes.

Figure 1:
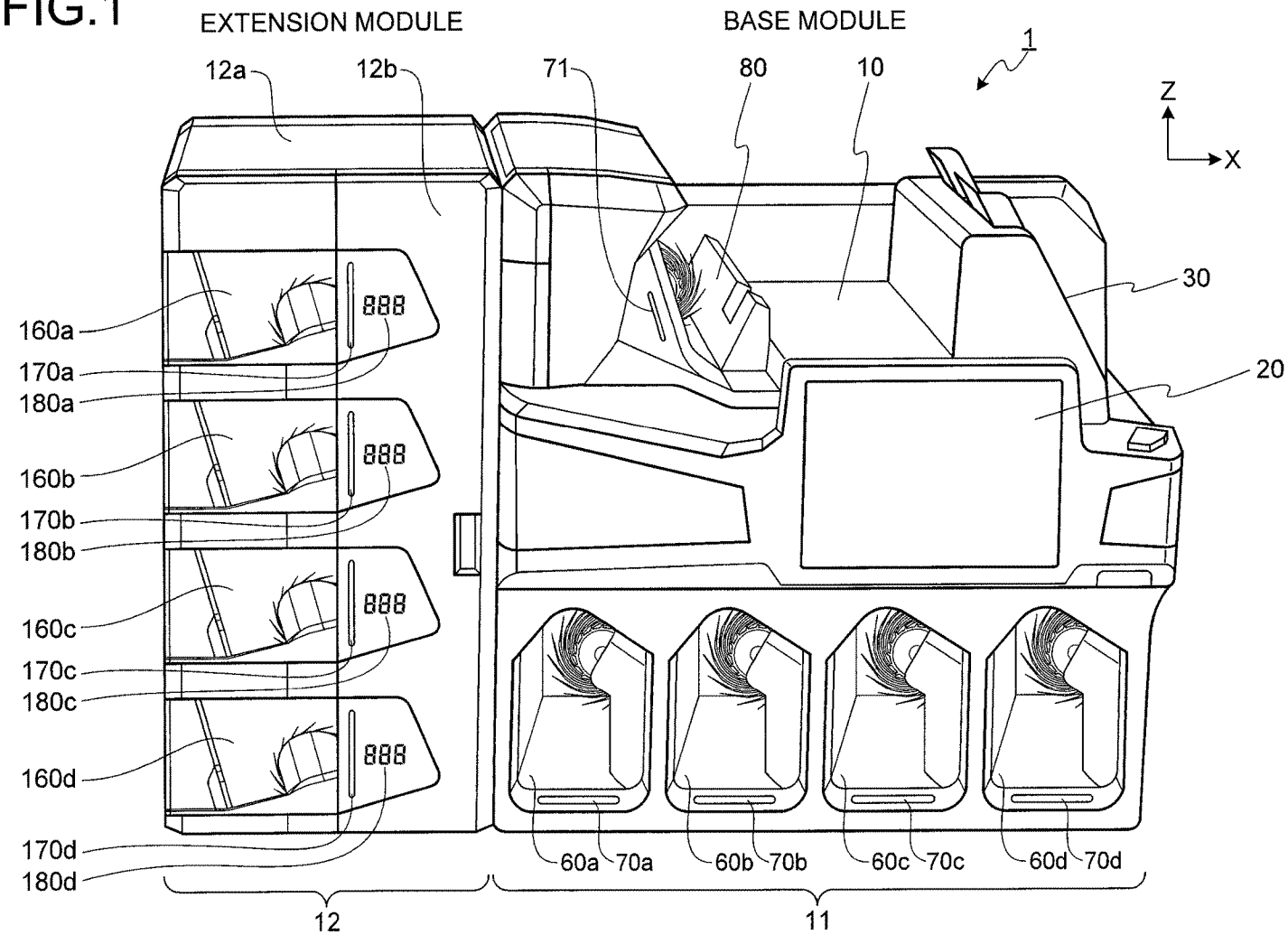
FIG. 1 is an external view of a banknote handling apparatus according to one embodiment of the invention.

A first embodiment of the banknote handling apparatus according to the present invention is explained by referring to FIGS. 1 to 5. FIG. 1 is an external view of a banknote handling apparatus 1. The banknote handling apparatus 1 includes a base module 11 and an extension module 12 connected to a left-side surface of the base module 11. The base module 11 includes an operation/display unit 20, a feeding unit 30, a reject unit 80, and a plurality of first-type stacking units 60 (60*a* to 60*d*). The extension module 12 includes a plurality of second-type stacking units 160 (160*a* to 160*d*).

In the first embodiment, a surface of the apparatus on which the operation/display unit 20 has been arranged will be referred to as a front face of the apparatus. Moreover, when an operator operates the operation/display unit 20 to perform banknote handling, the side of the apparatus on the right of the operator is referred to as a right side and the side of the apparatus on the left of the operator is referred to as a left side. An XYZ coordinate system is shown in the figures showing the configuration of the banknote handling apparatus 1. An XY-plane is parallel to a bottom face of the banknote handling apparatus 1. The positive X-axis direction of the XYZ coordinate corresponds to the right side.

As shown in FIG. 1, the base module 11 has a planar surface 10 between the feeding unit 30 and the reject unit 80. The planar surface 10 is substantially horizontal. A banknote or the like can be put on this planar surface 10. The planar surface 10 present on an upper side of the operation/display unit 20 is provided by a housing of the base module 11. The planar surface 10 may alternatively be inclined such that the height on the front edge is higher than the same on the back edge. Moreover, one or more convex portion may be provided on the planar surface 10. Each convex portion may be elongate and extend from the front edge to the back edge. Each convex portion may have a circular shape, a rectangular shape, or the like.

The operation/display unit 20 is arranged above the first-type stacking units 60 on or in a front surface of the base module 11. The operation/display unit 20 is arranged offset centrally with respect to the first-type stacking units 60 in the horizontal direction. Specifically, the operation/display unit 20 is arranged at the position on a perpendicular line that passes through a center in the horizontal direction between the stacking units 60*a* and 60*d* that are present on the both ends.

The operation/display unit 20 includes a touch panel liquid crystal display. The operation/display unit 20 can display one or more buttons on a screen. The operation/display unit 20 functions as an operating unit that can accept input of various pieces of information by operation of those buttons. The operation/display unit 20 also functions as a display unit that displays on the screen various pieces of information such as characteristics, quantity, and the like of banknotes being stacked in the first-type stacking units 60 and the second-type stacking units 160. The operation/display unit 20 may include, instead of the touch panel liquid crystal display, a non-touch panel liquid crystal display and one or more physical buttons.

The feeding unit 30 has the function of receiving banknotes, which have been placed thereon by the operator, one by one inside the apparatus. The reject unit 80 has the function of stacking one or more reject banknotes. For example, banknotes that are not recognized by the banknote handling apparatus 1 are stacked as reject banknotes. The first-type stacking units 60 are, for example, four stacking units 60*a* to 60*d*. The stacking units 60*a* to 60*d* are arranged side by side in a left-right direction (horizontal direction). Each of the stacking units 60*a* to 60*d* has the function of stacking normal banknotes, i.e. those that are recognized by the banknote handling apparatus 1. The first-type stacking unit 60 has an opening on a front face of the apparatus for removal of banknotes stacked in a stacking space thereof. The operator can remove banknotes stacked in the stacking space of the first-type stacking unit 60 through this opening. To make it easy for the operator to visually check the presence/absence of banknotes being stacked in the stacking space, the opening has, for example, a five-cornered shape with a top edge thereof including an apex. The apex and the two sides extending downwards from the apex constitute an upper part of the opening. The upper part of the opening has an inclined surface in a predetermined range, and declines from the front of the apparatus to the back such that the height is greatest at the front surface and lowest at the back surface.

It is envisaged that the first-type stacking units 60 may include first pilot lamps 70 (70*a* to 70*d*) and the reject unit 80 includes a first pilot lamp 71. Each pilot lamp is provided by an illuminable body such as an LED. The banknote handling apparatus 1 turns on or flashes on/off a corresponding one of the first pilot lamps 70 and 71 to notify the operator of the position of the stacking unit that needs attention. For example, when the stacking unit 60*a* becomes full of stacked banknotes and an operation for taking out the banknotes becomes necessary, the banknote handling apparatus 1 turns on or flashes on/off the first pilot lamp 70*a* to alert the operator.

The second-type stacking unit 160 has the function of stacking normal banknotes that are recognizable by the banknote handling apparatus 1. The second-type stacking units 160 are, for example, four stacking units 160*a* to 160*d*. The stacking units 160*a* to 160*d* are arranged one above the other in an up-down direction (vertical direction). That is, the arrangement direction of the second-type stacking units 160 is orthogonal to the arrangement direction of the first-type stacking units 60. The four stacking units 160*a* to 160*d* that are the second-type stacking units 160 and the four stacking units 60*a* to 60*d* that are the first-type stacking units 60 are arranged in a substantially L-shaped configuration.

The second-type stacking unit 160 has an opening on the front surface of the apparatus 1. The operator can remove banknotes stacked in the second-type stacking unit 160 through this opening. In what constitutes a stacking space of the second-type stacking unit 160, a curved cutout portion extends from the front surface around the left-side and towards the rear surface. Each cutout portion is formed in an opposing surface of the extension module 12 to the one against which the base module 11 is connected.

The second-type stacking units 160 may include second pilot lamps 170 (170*a* to 170*d*) each of which is constituted by an illuminable body such as an LED. The banknote handling apparatus 1 turns on or flashes on/off a corresponding one of the second pilot lamps 170 to notify the operator of the position of the second-type stacking unit 160 that needs attention. For example, when the stacking unit 160*a* becomes full of stacked banknotes and an operation for taking out the banknotes becomes necessary, the banknote handling apparatus 1 turns on or flashes on/off the first pilot lamp 170*a* to alert the operator.

The second-type stacking units 160 may include banknote number display units 180 (180*a* to 180*d*) each of which displays information about the quantity of banknotes stacked in each of the second-type stacking units 160. For example, the banknote handling apparatus 1 displays on the banknote number display unit 180 the quantity of banknotes being stacked in the second-type stacking unit 160 to inform the same to the operator.

The extension module 12 is detachably attached to the base module 11. The extension module 12 is connected to the base module 11 at a position where a front surface thereof constitutes substantially the same plane as the front surface of the base module 11.

A top surface 12*a* of the extension module 12 can be opened upwards. The front surface of the extension module 12 is divided in a left-side part on which the second-type stacking units 160 are arranged and a right-side part on which the second pilot lamps 170 and the banknote number display units 180 are arranged. A right front surface 12*b* can be opened outwardly from the front surface. A transport path present inside the banknote handling apparatus 1 is exposed by opening the top surface 12*a* and the right front surface 12*b* of the extension module 12. The details are explained later.

Figure 2:
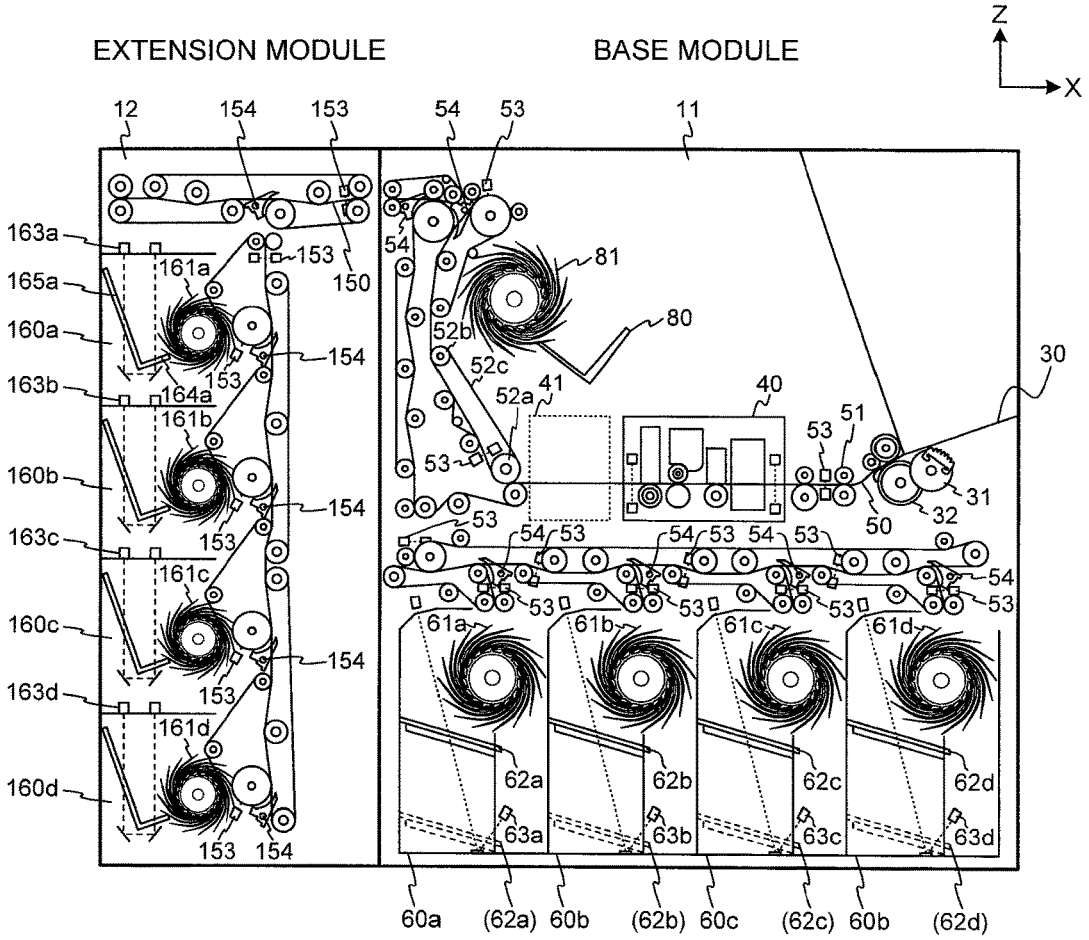
FIG. 2 is a schematic cross sectional view showing an internal configuration of the banknote handling apparatus.

FIG. 2 is a schematic cross sectional view showing an internal configuration of the banknote handling apparatus 1. A kicker roller 31 kicks toward the inside of the base module 11, a bottommost banknote among the banknotes set on the feeding unit 30 in a stacked manner. The kicked banknote is fed inside the apparatus by a feed roller 32. Inside the base module 11, a first transport unit 50 transports the banknote fed into the apparatus. The banknote is taken inside the apparatus with a leading long edge thereof in a transport direction, and the banknote is transported in a direction that is parallel to a short edge thereof.

The first transport unit 50 includes transport rollers, transport belts, banknote detection sensors 53, and diverters 54. In FIG. 2, although a reference number has been shown to indicate only one transport roller 51, the first transport unit 50 includes a plurality of such transport rollers 51. Similarly, in FIG. 2, although a reference number has been shown for only one transport belt 52*c* that is stretched over a plurality of rollers 52*a* and 52*b*, the first transport unit 50 includes a plurality of such transport belts. The transport rollers and the transport belts constitute the transport path along which the first transport unit 50 transports the banknote. The banknote detection sensor 53 arranged in the transport path has the function of detecting the position of a banknote being transported along the transport path. Diverter 54 is arranged at a diverting position where the transport path is branched into a plurality of further transport paths. A transport direction of the banknote can be changed by rotating the diverter 54.

A recognition unit 40 is arranged on the transport path. The recognition unit 40 recognizes the type of the banknote that is being transported by the first transport unit 50. The recognition unit 40 includes, for example, a line sensor that acquires a transmission image of the banknote, a reflection image of a front surface of the banknote, and a reflection image of a back surface of the banknote, a UV sensor that detects emission excited when the banknote is irradiated with a UV light (ultraviolet light), a thickness detection sensor that detects a thickness of the banknote, and a magnetic sensor that detects a magnetic characteristic of the banknote. The recognition unit 40 recognizes a denomination, authenticity, fitness, face/back direction, orientation, and the like of the banknote based on the optical properties, the magnetic characteristic, the thickness, and the like of the banknote obtained by the sensors.

The broken line 41 in FIG. 2 shows an arrangement space for accommodating an optional recognition unit in the banknote handling apparatus 1. The arrangement space is at a position downstream of the recognition unit 40 in the transport direction. The optional recognition unit can be installed in this arrangement space if necessary. For example, when a particular sensor, such as an ultrasonic sensor, becomes necessary for recognizing the banknote handled in the banknote handling apparatus 1, the optional recognition unit including such a sensor is installed in the place shown with the broken line 41 and used.

The banknote that has passed the recognition unit 40 is transported upwardly to the diverting position located at an upper left part in the apparatus 1. Two diverters 54 are provided at the diverting position. The transport direction of the banknote can be altered to one of three directions: a right direction, a left direction, and a lower direction that is a turnaround direction of the transport path. The banknote transported to the diverting position is diverted based on a recognition result obtained by the recognition unit 40. Specifically, the banknote is transported to any one of the following: the reject unit 80 present in the right direction, the first-type stacking units 60 present in the lower direction, and the second-type stacking units 160 present in the left direction.

The rejected banknote, such as the banknote whose type could not be recognized by the recognition unit 40 or a banknote that is recognized by the recognition unit 40 as being a counterfeit banknote, is diverted at the diverting position to the right direction, and such a banknote is stacked in the reject unit 80. The reject unit 80 includes a stacking wheel 81. The stacking wheel 81, while rotating clockwise, receives the reject banknote between two adjacent blades thereof and orderly stacks the banknote in the reject unit 80.

A genuine banknote whose denomination and the like was recognized by the recognition unit 40 is diverted at the diverting position to the lower direction or the left direction as a normal banknote. The normal banknote diverted at the diverting position to the lower direction is stacked in the first-type stacking unit 60 of the base module 11. The normal banknote diverted at the diverting position to the left direction is stacked in the second-type stacking unit 160 of the extension module 12. Depending on the type of the banknote to be stacked in each of the stacking units, the banknotes are stacked in the four stacking units 60*a* to 60*d* and the four stacking units 160*a* to 160*d*. In other words, each banknote is stacked in a corresponding one of the stacking units 60*a* to 60*d* and 160*a* to 160*d* based on the recognition result obtained by the recognition unit 40 and the type of the banknote specified for each of the stacking units.

The first-type stacking unit 60 includes stacking wheels 61 (61*a* to 61*d*) that orderly stack the banknotes transported on the transport path, stages 62 (62*a* to 62*d*), and banknote detection sensors 63 (63*a* to 63*d*) that detect presence or absence of the stacked banknotes. The stacking wheel 61, while rotating counterclockwise, receives the banknote, between two adjacent blades thereof and orderly stacks the banknote on the stage 62. The stage 62 is movable in the up-down direction in an inclined state with a right side, on which the stacking wheel 61 is arranged, being at a lower level. In each of the stacking units 60*a* to 60*d*, the banknote is stacked, in a stacked manner, with a banknote face parallel to the stages 62*a* to 62*d*, and the long edge of the banknote in contact with a right-side wall of the stacking units 60*a* to 60*d*. The stacking of the banknotes on the stage 62 is started when the stage 62 is positioned at an uppermost position thereof shown with a continuous line in FIG. 2, and the stage 62 is moved downwards as the quantity of the stacked banknotes increases. Each of the stacking units 60*a* to 60*d* can stack up to 500 banknotes as the corresponding one of the stages 62*a* to 62*d* moves to a lowermost position thereof, shown with a broken line in FIG. 2.

The banknote that is diverted to the left direction from the diverting position arranged in the upper left part within the base module 11 is discharged to the outside of the base module 11 from the left-side surface of the base module 11. A second transport unit 150 transports the banknote discharged from the base module 11 inside the extension module 12.

The second transport unit 150 includes transport rollers, transport belts, banknote detection sensors 153, and diverters 154. The transport rollers and the transport belts constitute the transport path along which the second transport unit 150 transports the banknote. The banknote detection sensor 153 arranged in the transport path has the function of detecting the position of a banknote being transported on the transport path. The diverter 154 arranged at a diverting position where the transport path is branched into a plurality of yet further transport paths. A transport direction of the banknote can be changed by rotating the diverter 154.

The banknote that has been discharged from the base module 11 and taken inside the extension module 12 is transported toward a diverting position arranged at a substantially central position in an upper part of the extension module 12. At the diverting position, by controlling rotation of the diverter 154, the transport direction of the banknote can be changed to any one of two directions: a left direction and a lower direction. The transport path present on the left side of the diverting position is a transport path for transporting the banknote, which has been taken inside of the extension module 12, to another extension module. In FIG. 2, only one extension module 12 is shown; however, in the banknote handling apparatus 1, a plurality of the extension modules 12 may be arranged in a left-right direction, connected in series. When another extension module is connected on the left side of the extension module 12 shown in FIG. 2, the banknote that is diverted to the left direction at the diverting position is transported to this additional extension module.

The transport path arranged on a lower side of the diverting position is a transport path for transporting the banknote to the second-type stacking unit 160 based on the recognition result obtained by the recognition unit 40. An empty cavity is provided on a right side of the transport path, underneath the diverting position. The transport path that transports the banknote to the lower direction in the left side in the base module 11 and the transport path that transports the banknote to the lower direction in a substantially central part in the extension module 12 can be opened by using this space. The details are explained later.

The second-type stacking unit 160 includes stacking wheels 161 (161*a* to 161*d*) that orderly stack the banknotes transported on the transport path, and banknote detection sensors 163 (163*a* to 163*d*) that detect presence/absence of the stacked banknote.

Each of the second-type stacking units 160*a* to 160*d* can stack, for example, up to 125 banknotes. The number 125, which is the maximum quantity of banknotes that can be stacked in any one of the stacking units 160*a* to 160*d*, is a divisor of the number 500, which is the maximum number of banknotes that can be stacked in any one of the first-type stacking units 60*a* to 60*d*. That is, if 125 banknotes are stacked in each of the four stacking units 160*a* to 160*d*, it is possible to stack 500 banknotes in total.

When all of the four second-type stacking units 160*a* to 160*d* are full with banknotes, the number of banknotes stacked in the second-type stacking units 160 will be equal to the number of the banknotes that can be stacked in any one of the first-type stacking units 60*a* to 60*d*. The operator can consider the one extension module 12 as one stacking unit and use it as such. Specifically, by performing a predetermined operation with the operation/display unit 20, a control unit 90 considers the one extension module 12 as one stacking unit for stacking the banknotes. Thus, the operator can consider the combined four stacking units 60*a* to 60*d* and the one extension module 12 together as five stacking units, each capable of stacking up to 500 banknotes and perform the banknote handling. In this case, the banknote handling apparatus 1 stacks the banknotes, which are to be stacked in the extension module 12 due to the recognition result obtained by the recognition unit 40, sequentially in the four stacking units 160*a* to 160*d*.

When using the extension module 12 as one stacking unit, the operator can specify the order in which the banknotes are to be stacked in the four stacking units 160*a* to 160*d*. For example, in the banknote handling apparatus 1, it is allowable to specify starting the stacking of the banknotes from the topmost stacking unit 160*a*, and alter the stacking destination of the banknotes towards stacking unit 160*b*, stacking unit 160*c*, and stacking unit 160*d* as and when each stacking unit becomes full. Alternatively, it is allowable in the banknote handling apparatus 1 to specify starting the stacking of the banknotes from the bottommost stacking unit 160*d* and then stack the banknotes in the order of stacking unit 160*c*, stacking unit 160*b*, and stacking unit 160*a*. The operator can increase the quantity of extension modules 12 to be connected to the base module 11 and can use the banknote handling apparatus 1 as an apparatus that has six or more stacking units, each capable of stacking up to 500 banknotes.

An external diameter of the stacking wheel 61 of the first-type stacking unit 60 is, for example, 100 mm. An external diameter of the stacking wheel 161 of the second-type stacking unit 160 is smaller than that of the stacking wheel 61 of the first-type stacking unit 60 and is, for example, 70 mm. The stacking wheel 61 of the first-type stacking unit 60 has 16 blades, whereas the stacking wheel 161 with the smaller external diameter has 12 blades. The stacking wheels 61 and 161 shown in FIGS. 1 and 2 are arranged in a plurality on the same rotation axis. Specifically, in each of the first-type stacking units 60*a* to 60*d* two stacking wheels 61 are arranged side-by-side along the Y-axis direction. Moreover, in each of the second-type stacking units 160*a* to 160*d* four stacking wheels 161 are arranged side-by-side along the Y-axis direction (best seen in FIG. 3B). The external diameter of each stacking wheel 161 is small and a length from the base to the tip of the blade is short. However, since four stacking wheels 161 are arranged in one stacking unit, the banknote transported to the second-type stacking unit 160 can be received safely and stacked orderly.

Figure 3A:
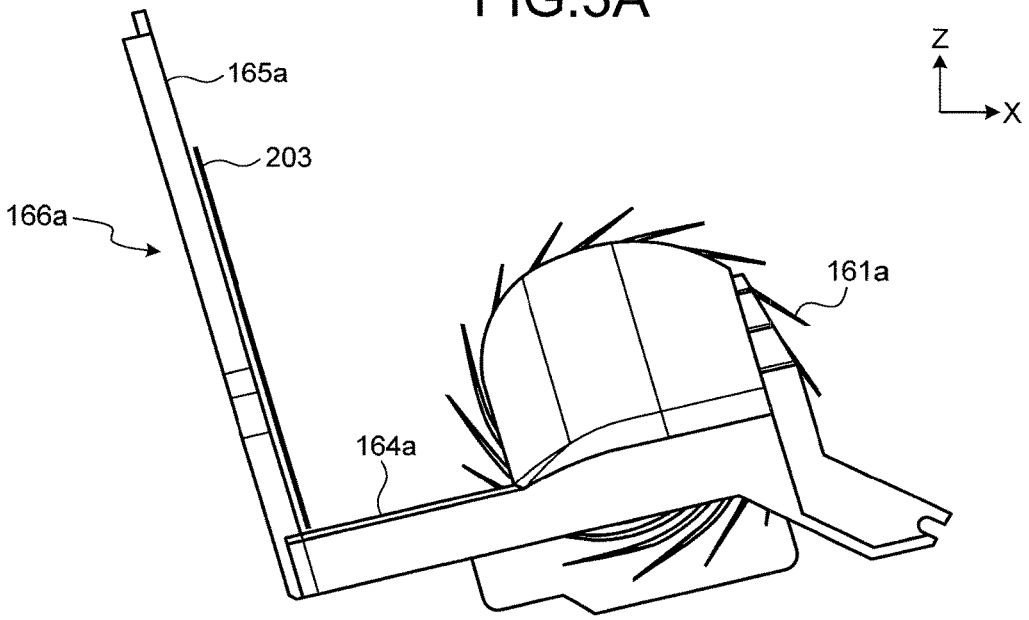
FIGS. 3A and 3B are views of an internal structure of a second-type stacking unit.
Figure 3B:
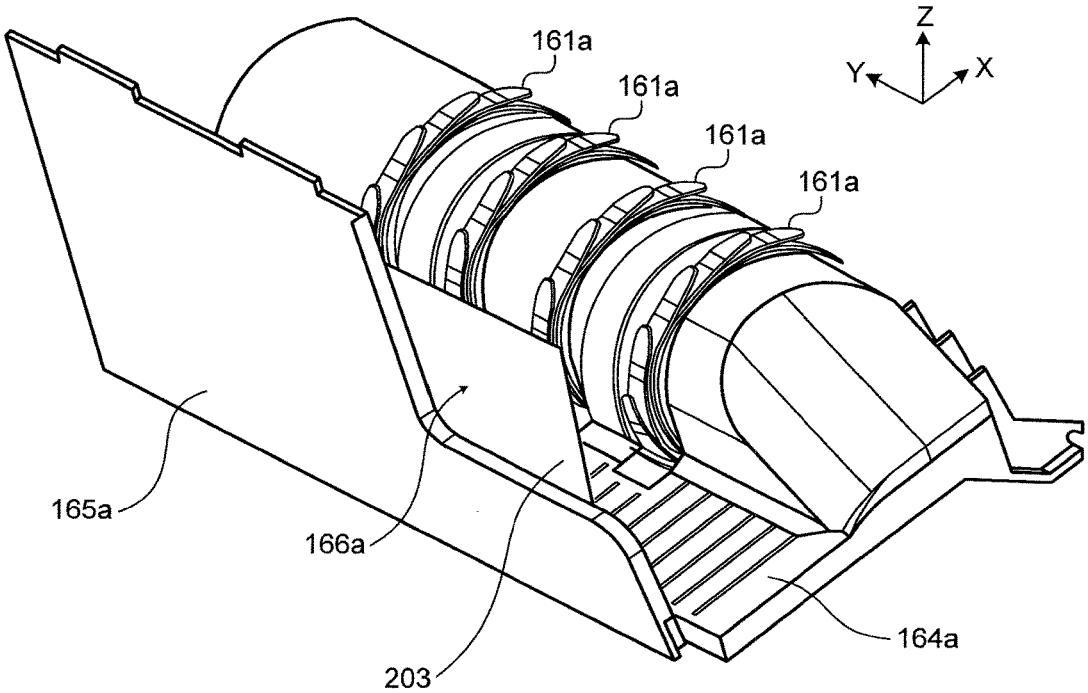

Because each of the second-type stacking units 160*a* to 160*d* has a substantially identical configuration, a method of stacking of the banknote is explained below by taking stacking unit 160*a* as an example. FIGS. 3A and 3B are views of an internal structure of the second-type stacking unit 160. FIGS. 3A and 3B show a part of an interior of the stacking unit 160*a* shown in FIG. 2.

As shown in FIG. 3A, a left-side wall 165*a* and a base wall 164*a* form an L-shaped structure with an upper part of the left-side wall 165*a* inclined outwards towards a left side, thereby constituting a stacking space in which a banknote 203 may be stacked. A lower end of the left-side wall 165*a* is connected to a left end of the base wall 164*a*. The four stacking wheels 161*a*, while rotating counterclockwise, receive the banknote that has been transported by the second transport unit 150 between two adjacent blades thereof and send the banknote toward the left-side wall 165*a*. The base wall 164*a* is inclined so that a left side thereof is at a lower level than a right side thereof on which the stacking wheel 161*a* is arranged. The banknote, which is sent by the stacking wheel 161*a*, after being separated from the stacking wheel 161*a*, moves toward the left-side wall 165*a*, and is stacked such that the banknote face is parallel to a wall surface of the left-side wall 165*a*. As a result, as shown in FIG. 3A, the banknote 203 is stacked in an inclined standing state. An angle of inclination between the banknote face of the banknote 203, which has been stacked with the banknote face aligned to the wall surface of the left-side wall 165*a*, and a horizontal plane is, for example, 45 degrees or more. That is, in FIGS. 3A and 3B, on the left side of the stacked banknote 203, the angle between the banknote face and the horizontal plane is 45 degrees or more. An angle of inclination between the banknote face of the banknote stacked in the first-type stacking unit 60 shown in FIG. 2 and the horizontal plane is 45 degrees or less. Thus, the angle of inclination of the banknote stacked in the first-type stacking unit 60 with the horizontal plane is less than the same in the second-type stacking unit 160.

As shown in FIGS. 3A and 3B, the banknote 203 stacked in the stacking space of the second-type stacking unit 160 is stacked with the long edge thereof in contact with a bottom surface (top surface of the base wall 164*a*) and the short edge thereof toward the front side of the apparatus 1. The banknote 203 is stacked in the inclined standing state so that an upper portion of the short edge of the banknote 203 is inclined toward a left outer direction of the banknote handling apparatus 1 than a lower portion of the short edge. By stacking the banknote 203 in such a standing state, a width of the stacking space of the second-type stacking unit 160 can be reduced in comparison to a structure in which the banknote is stacked with the banknote face thereof horizontal.

A cutout portion 166*a* extending from the front surface in a curved manner toward the back surface (see FIG. 10B) is formed on the left-side surface of the second-type stacking unit 160. In correspondence with this, as shown in FIG. 3B, a front upper side of the left-side wall 165*a* of the stacking unit 160*a* has a cutout shape. An upper part of a front side of the banknote 203 stacked in the inclined standing state in the stacking space of the stacking unit 160*a* is exposed by the cutout portion 166*a*. As a result, the operator can grip the portion of the banknote 203 exposed by the cutout portion 166*a*, and easily remove the banknote 203.

Figure 4:
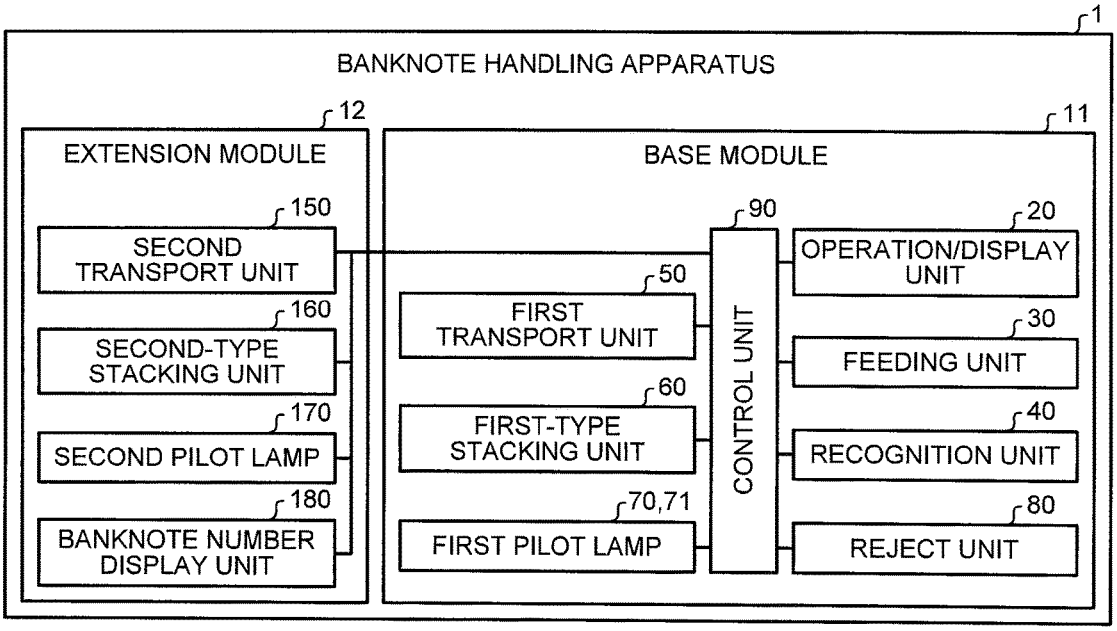
FIG. 4 is a block diagram indicating an outline of a functional configuration of the banknote handling apparatus.

FIG. 4 is a block diagram indicating an outline of a functional configuration of the banknote handling apparatus 1. The banknote handling apparatus 1 includes the various structural components shown in FIGS. 1 and 2 and control unit 90. Various processes performed in the banknote handling apparatus 1 are realized by the control unit 90 controlling the various structural components.

Although not shown in FIG. 4, the base module 11 can include a connecting terminal for connecting thereto various apparatus such as a handy scanner and a barcode reader. For example, when processing a banknote in a money deposit transaction, the operator can scan a deposit slip, on which information about the money deposit process has been written, using the handy scanner connected to the base module 11. The control unit 90 performs a character recognition process on the image of the deposit slip captured by the handy scanner and acquires money deposit process information, such as a money deposit process number, and the amount of money to be deposited. Similarly, when the operator reads a barcode, in which information about the money deposit process is encoded, using the barcode reader, the control unit 90 recognizes the barcode and acquires the money deposit process information, such as the money deposit process number, and the amount of the money to be deposited.

The base module 11 includes a connecting terminal for performing data communication with an external device such as a server device. Accordingly, the control unit 90 can acquire information from the external device that manages the banknote handling such as money deposit processes. For example, the control unit 90 acquires from the external device the information about the money deposit process, such as the money deposit process number and the amount of the money to be deposited. The control unit 90 compares, based on the money deposit process number, the money deposit process information acquired by using the barcode reader or the handy scanner and the corresponding money deposit process information acquired from the external device. If both do not match, the control unit 90 communicates this using the operation/display unit 20.

The handy scanner may also be used to handle the reject banknote. For example, when a reject banknote is found when performing a serial number reading process and a recognition and counting process of the deposited banknote in the banknote handling apparatus 1, the operator scans the banknote face of the reject banknote with the handy scanner. Then, the operator operates the operation/display unit 20 and manually inputs predetermined information such as a serial number and a denomination of the reject banknote. The control unit 90 performs character recognition of the serial number from the image of the reject banknote captured with the handy scanner and manages the result with the information input manually. Meanwhile, a serial number reading process and a recognition and counting process of a normal banknote is performed by the recognition unit 40. When the recognition and counting of all the deposited banknotes is complete, the control unit 90 displays on the operation/display unit 20 the information such as the denomination(s) and the number of the reject banknotes input manually and the result of recognition and counting of the normal banknotes obtained by the recognition unit 40. When the operator performs an operation to confirm and approve the information displayed on the operation/display unit 20, the control unit 90 manages the information about the reject banknotes and the information about the normal banknotes as a money deposit process result. When the setting is to transmit the money deposit process result to the external device, such as the external server, the control unit 90 transmits the money deposit process result to the external device.

Figure 5:
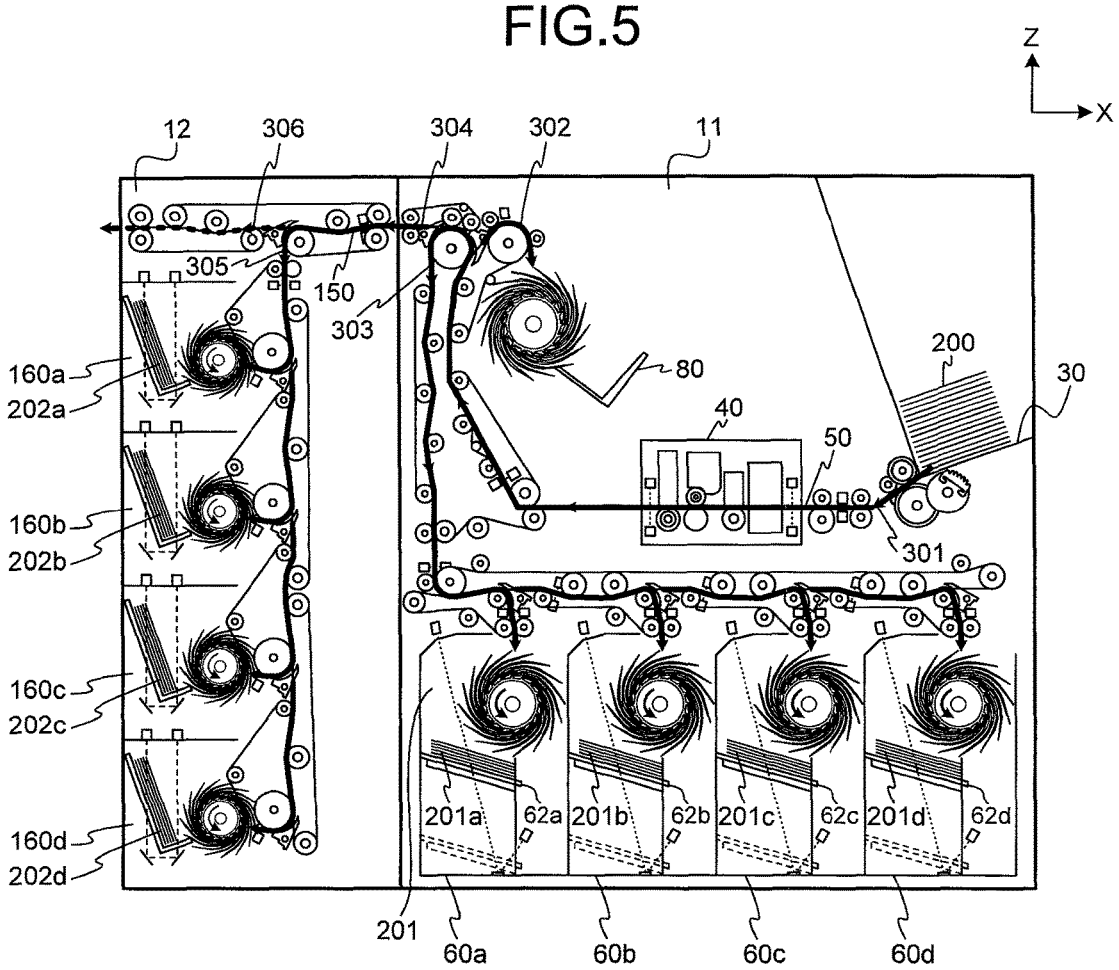
FIG. 5 is a schematic diagram indicating transport of a banknote within the banknote handling apparatus.

FIG. 5 is a schematic diagram indicating transport of the banknotes in the banknote handling apparatus 1. Several banknotes 200 set on the feeding unit 30 are sequentially taken inside the base module 11, as shown with an arrow 301, starting from the bottommost banknote. In the base module 11, the first transport unit 50 transports the banknote. The banknote recognized in the recognition unit 40 is transported toward the diverting position arranged in the left upper part within the base module 11. The reject banknote is diverted, as shown with an arrow 302, toward the right direction, and it is stacked in the reject unit 80 after passing through the diverting position. The banknote to be stacked in the first-type stacking unit 60 is diverted toward the lower direction as shown with an arrow 303, and after passing through the diverting position, it is stacked in a corresponding one of the stacking units 60*a* to 60*d* based on the recognition result obtained by the recognition unit 40. Banknotes 201 (201*a* to 201*d*) stacked in the first-type stacking unit 60 have their banknote faces parallel to the stage 62 and are stacked in an orderly manner.

The banknote to be stacked in the second-type stacking unit 160 of the extension module 12 is diverted towards the left direction as shown with an arrow 304, and after passing through the diverting position, it is discharged from the base module 11 and fed to the extension module 12. In the extension module 12, the second transport unit 150 transports the banknote. The banknote taken inside the extension module 12 is transported to the left direction toward the diverting position arranged substantially centrally within the extension module 12. The banknote to be stacked in the second-type stacking unit 160 is transported toward the lower direction as shown with arrow 305, and after passing through the diverting position, it is stacked in a corresponding one of the stacking units 160*a* to 160*d* based on the recognition result obtained in the recognition unit 40. Banknotes 202 (202*a* to 202*d*) stacked in the second-type stacking unit 160 have their banknote faces parallel to the left-side wall and are stacked in the inclined standing state.

If another extension module has been connected on the left side of the extension module 12, the banknote to be transported to this extension module is transported to the left direction as shown with an arrow 306. The extension module 12 discharges, from the left-side surface, the banknote taken inside the extension module 12 from the right-side surface and sends the banknote to the other extension module.

Figure 6A:
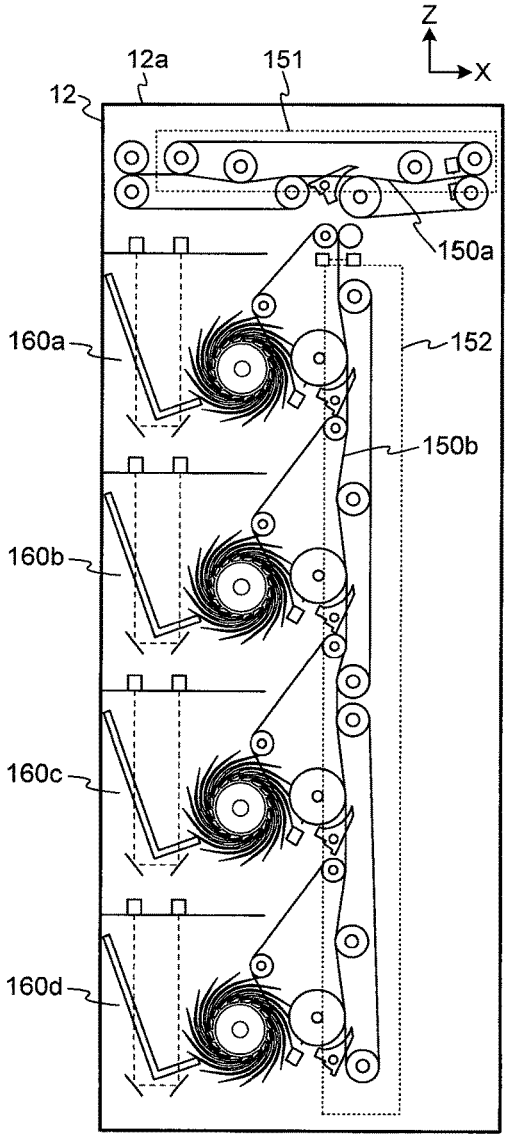
FIGS. 6A and 6B are schematic diagrams for explaining a method for removing a banknote from a transport path in an extension module.

Referring now to FIGS. 6A to 9B, an error clearance method for removing a jammed banknote from the transport path caused due to the occurrence of transport error is explained below. FIGS. 6A and 6B are schematic diagrams for explaining the method of removing the banknote from the transport path in the extension module 12. FIG. 6A shows only the extension module 12 of the banknote handling apparatus 1 shown in FIG. 2. FIG. 6B shows the transport path shown in FIG. 6A in an open state.

The transport path of the second transport unit 150, as shown in FIG. 6A, includes a horizontal transport path 150*a* that transports the banknote in the horizontal direction and a vertical transport path 150*b* that transports the banknote in the up-down direction. In an upper part of the horizontal transport path 150*a*, four transport rollers are provided and an upper transport belt stretches over said rollers. In a lower part of the horizontal transport path 150*a*, a diverter is arranged at the diverting position. A left-side transport belt stretches over two rollers that are arranged to the left hand side of the diverting position, and a right-side transport belt stretches over two rollers that are arranged to the right hand side of the diverting position. Rotational axes of the four rollers that drive the upper transport belt of the horizontal transport path 150*a* are supported by an upper-side unit 151 shown with a dashed line. In the horizontal transport path 150*a*, the banknote is transported between the upper transport belt supported by the upper-side unit 151, and the lower right-side transport belt or the lower left-side transport belt. The banknote is transported in a sandwiched state between the upper and lower transport belts.

Figure 6B:
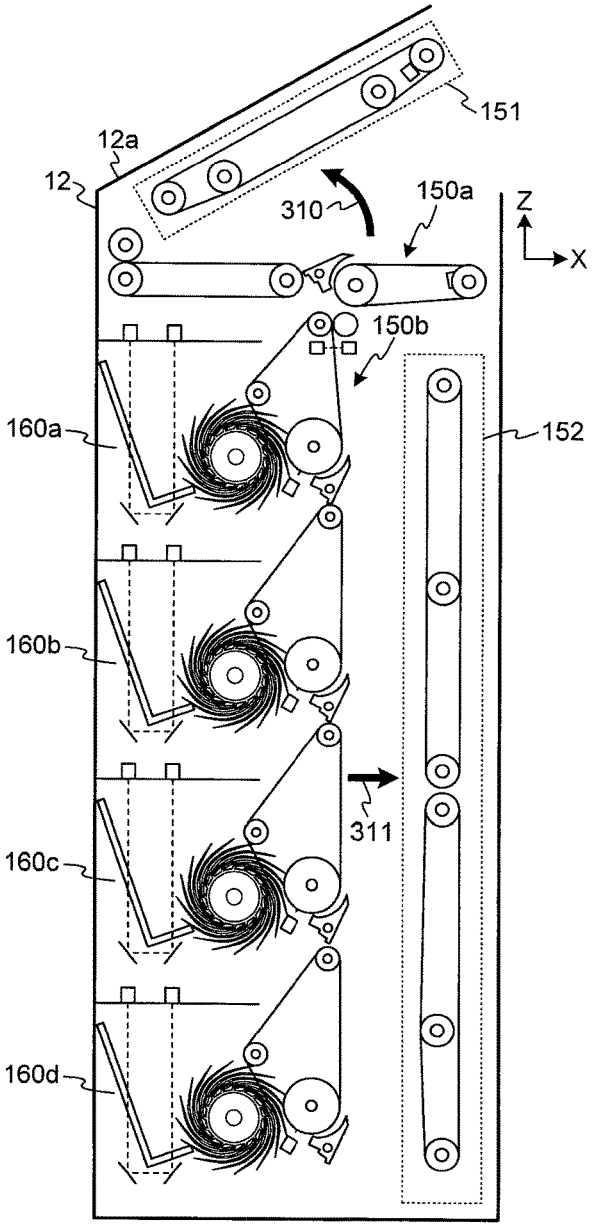

When a banknote is jammed in the horizontal transport path 150*a*, the top surface 12*a* and the upper-side unit 151 of the extension module 12 are opened upward as shown with an arrow 310 in FIG. 6B. A left end portion of the top surface 12*a* is pivotably supported by a support axis that extends in a front-back direction at an upper left-side surface inside of the extension module 12. The top surface 12*a* opens upward by pivoting around this support axis. The upper-side unit 151 is fixed to and supported by the top surface 12*a*, and the upper-side unit 151 is opened along with the top surface 12*a* and moves upward when the top surface 12*a* is opened. As a result, the horizontal transport path 150*a* can be opened as shown in FIG. 6B and the jammed banknote can be removed.

On the left side of the vertical transport path 150*b*, at a position corresponding to each of the stacking units 160*a* to 160*d*, a diverter that diverts the banknote to the corresponding one of the stacking units 160*a* to 160*d* is arranged and a transport belt stretches over three rollers. An upper transport belt stretched over three upper rollers and a lower transport belt stretched over three lower rollers are arranged on the right side of the vertical transport path 150*b*. Rotational axes of the three rollers that drive the upper transport belt and rotational axes of the three rollers that drive the lower transport belt are supported by a right-side unit 152 shown with a dashed line. In the vertical transport path 150*b*, the banknote is transported in a sandwiched state between the two transport belts of the upper transport belt and the lower transport belt supported by the right-side unit 152, and the transport belts that oppose these two transport belts and are arranged on the left side of the transport path 150*b*.

When a banknote is jammed in the vertical transport path 150*b*, the right-side unit 152 opens to the right side inside the extension module 12 as shown with arrow 311 in FIG. 6B. A back surface side portion of the right-side unit 152 is pivotably supported by a support axis that extends in the up-down direction inside the back surface of the extension module 12. The front surface of the right-side unit 152 opens to the right side as shown in FIG. 6B by pivoting the right-side unit 152 around the support axis. As a result, the vertical transport path 150*b* can be opened and the jammed banknote can be removed.

Figure 7A:
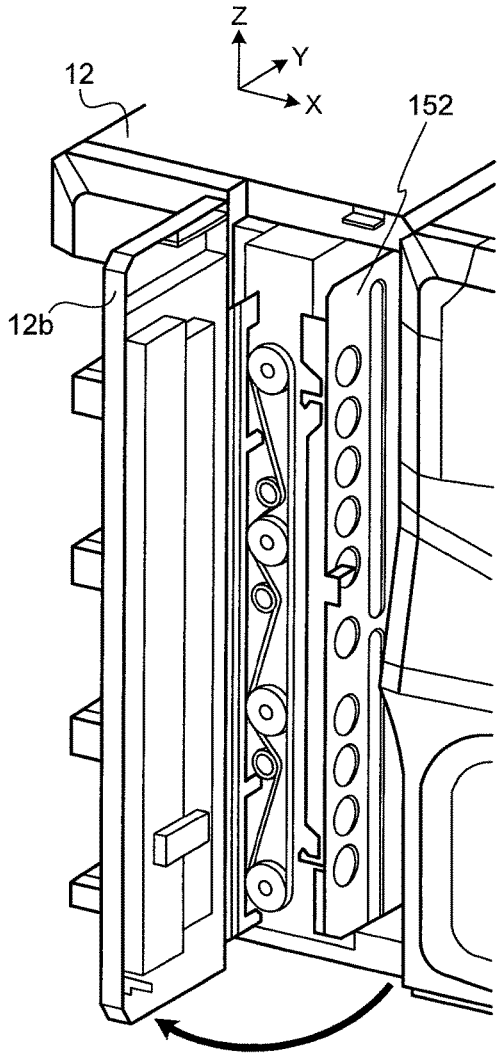
FIGS. 7A and 7B are perspective views for explaining a method of opening a right-side unit of the extension module to expose an internal part of the right-side unit.
Figure 7B:
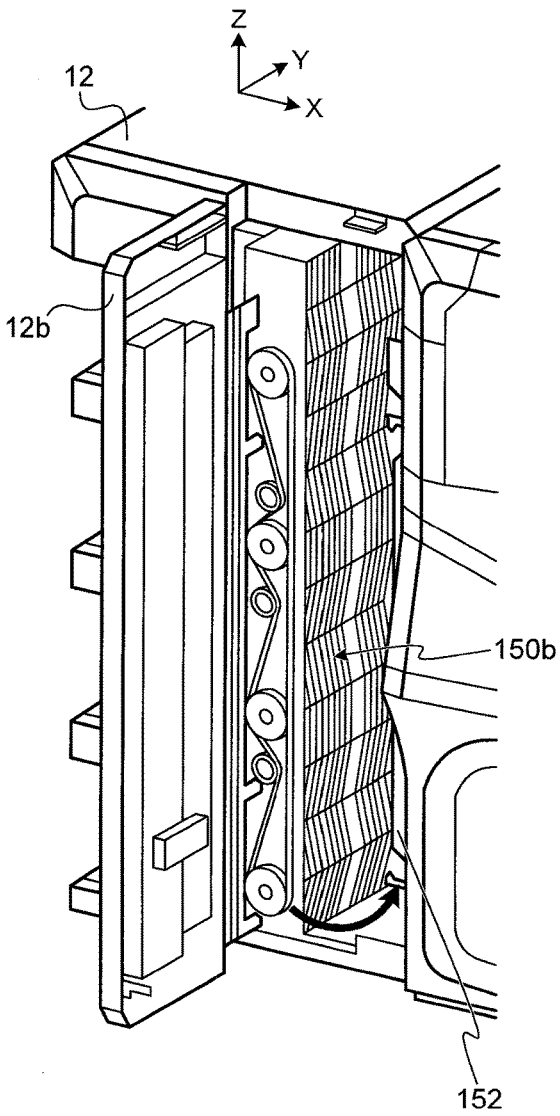

FIGS. 7A and 7B are perspective views for explaining a method of opening the right-side unit 152 in the extension module to expose an internal part of the right-side unit 152. As shown with an arrow in FIG. 7A, the right front surface 12*b* of the extension module 12 opens outwardly by pivoting around a support axis arranged on the left side of a back surface thereof. Then, as shown with an arrow in FIG. 7B, the vertical transport path 150*b* can be opened by pivoting the right-side unit 152 present inside the extension module 12 around the support axis arranged on the back surface.

Figure 8A:
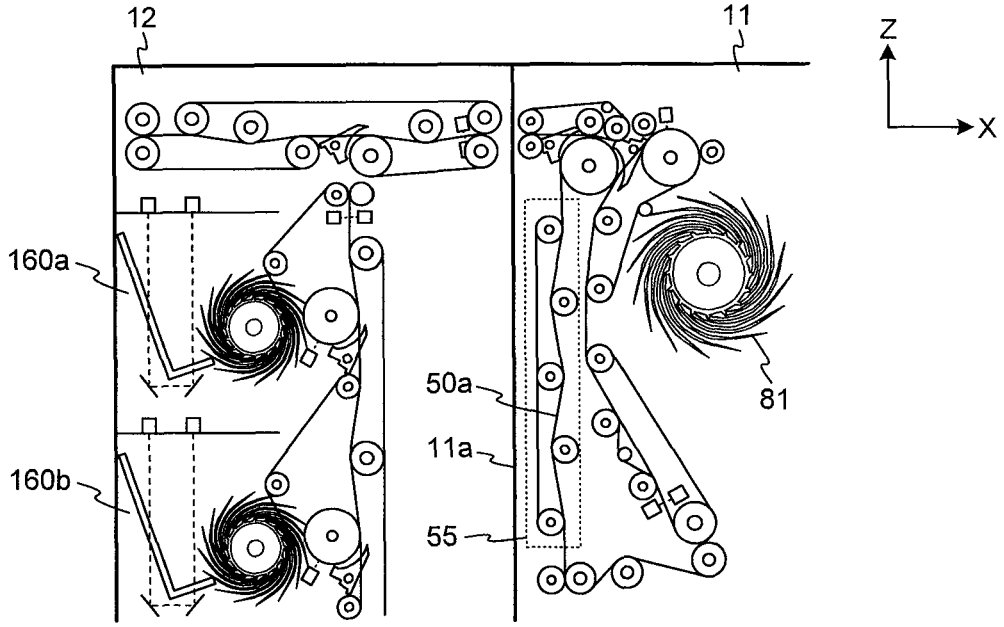
FIGS. 8A and 8B are schematic diagrams for explaining a method for removing a banknote from a transport path in a base module.
Figure 8B:
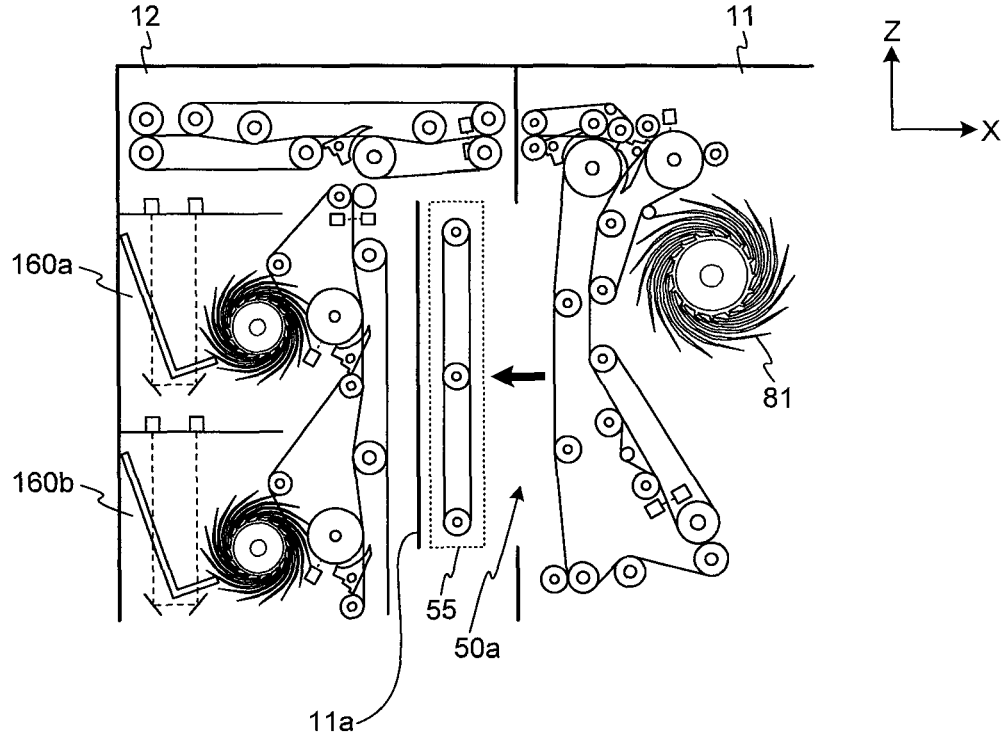

FIGS. 8A and 8B are schematic diagrams for explaining a method for removing a banknote from the transport path in the base module 11. FIG. 8A shows a part of the banknote handling apparatus 1 shown in FIG. 2. FIG. 8B shows a part of the transport path shown in FIG. 8A which is in an open state.

As shown in FIG. 8A, the first transport unit 50 of the base module 11 includes a vertical transport path 50*a* that transports the banknote to the lower direction. A left-side transport belt stretched over three rollers is arranged on the left side of the vertical transport path 50*a*. A right-side transport belt stretched over a plurality of rollers is arranged on the right side of the vertical transport path 50*a*. Rotational axes of the three rollers that drive the left-side transport belt of the vertical transport path 50*a* are supported by a left-side unit 55 shown with a broken line. In the vertical transport path 50*a*, the banknote is transported in a sandwiched state between the left-side transport belt supported by the left-side unit 55 and the right-side transport belt that opposes the left-side transport belt.

When a banknote is jammed in the vertical transport path 50*a*, a left-side surface 11*a* that constitutes a portion of a side surface of the base module 11 and the left-side unit 55 are opened to the left as shown with an arrow in FIG. 8B. A distal portion of the left-side surface 11*a* is pivotably about a support axis inside the base module 11. A proximal edge of the left-side surface 11*a* pivotally rotates to the left as shown in FIG. 9B. The left-side unit 55 is fixed to and supported by the left-side surface 11*a*, so that, when the left-side surface 11*a* is opened, the front surface side of the left-side unit 55 moves to the left side along with the left-side surface 11*a*, as shown in FIG. 8B. As a result, the vertical transport path 50*a* can be opened as shown in FIG. 8B and the jammed banknote can be removed.

Figure 9A:
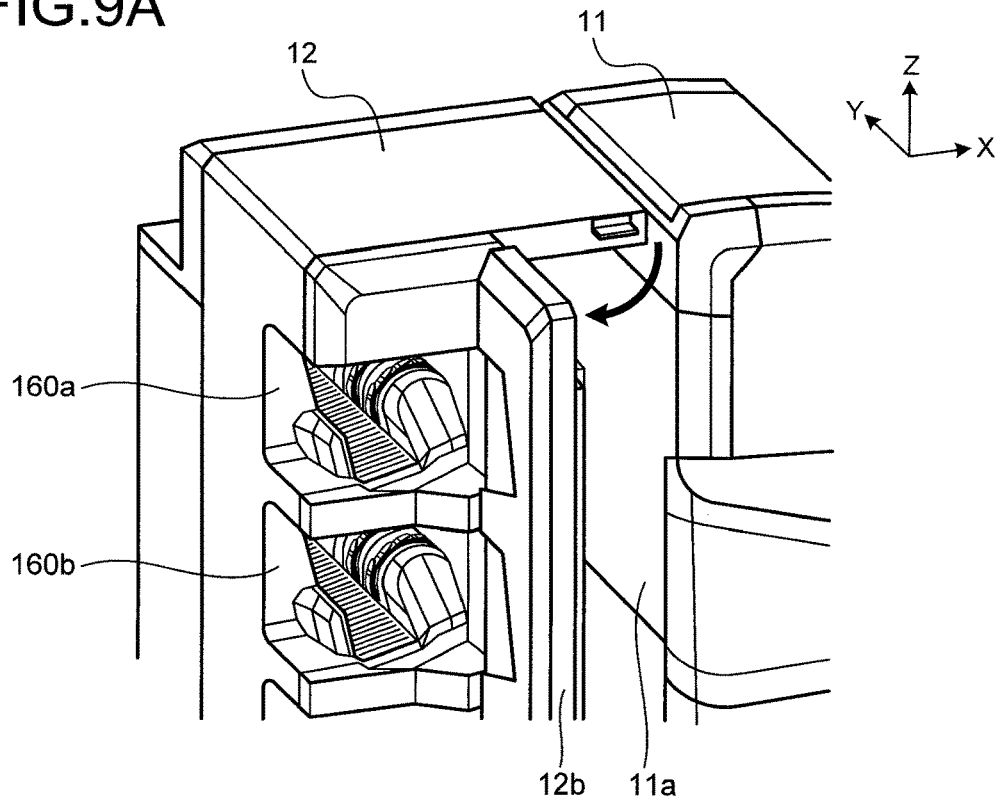
FIGS. 9A and 9B are perspective views for explaining a method of opening a left-side unit of the base module to expose an internal part of the left-side unit.
Figure 9B:
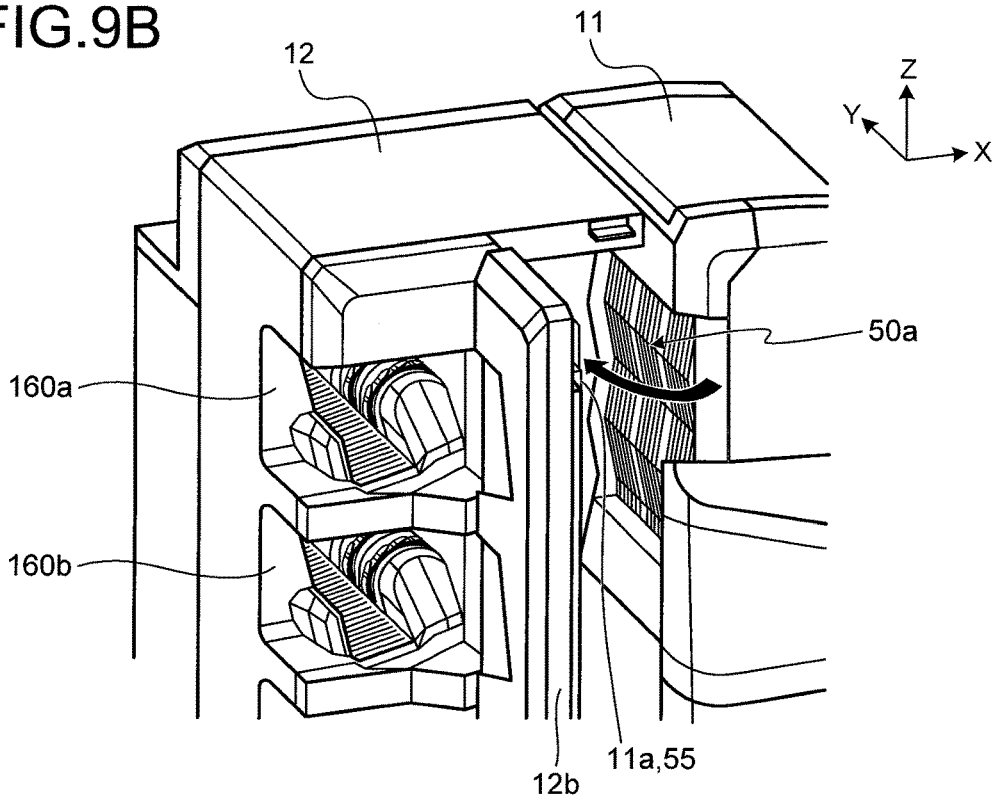

FIGS. 9A and 9B are perspective views for explaining a method of opening the left-side unit 55 of the base module 11 to expose an internal part of the left-side unit 55. As shown with an arrow in FIG. 9A, the right front surface 12*b* of the extension module 12 opens to the front surface side of the apparatus by pivoting around the support axis arranged on the left side of the back surface. Then, as shown with an arrow in FIG. 9B, the vertical transport path 50*a* can be opened by pivoting the left-side surface 11*a* of the base module 11 present inside the extension module 12 around the support axis arranged on the back surface side and opening the front surface side to the left side.

Inside of the extension module 12, below the horizontal transport path 150*a*, on the right side of the vertical transport path 150*b*, is secured a cavity for opening the transport path. As a result, as shown in FIGS. 6B and 7B, the transport path can be opened by moving the right-side unit 152 that constitutes the vertical transport path 150*b* of the extension module 12 to the right side.

As shown in FIG. 9A, in the state that the extension module 12 is connected to the base module 11, the left-side surface of the base module 11 is exposed in the inner space of the extension module 12. As a result, as shown in FIGS. 8B and 9B, by moving the left-side unit 55 constituting the vertical transport path 50*a* in the base module 11 to the left side along with the left-side surface 11*a* inside the extension module 12, the transport path can be opened.

Both the first-type stacking unit 60 and the second-type stacking unit 160 have the openings for taking out the banknotes stacked in the stacking spaces. It is envisaged to provide a shutter for each opening. Specifically, a shutter is provided in each of the stacking units for opening/closing the opening. The shutter is usually kept closed and it is opened only when removing the banknotes.

Figure 10A:
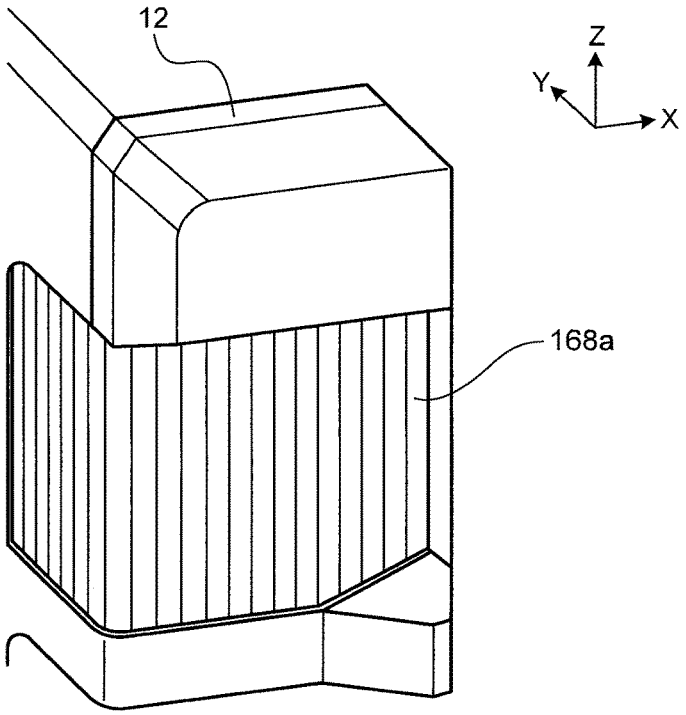
FIGS. 10A and 10B are perspective views of an example in which a shutter is arranged in the second-type stacking unit.
Figure 10B:
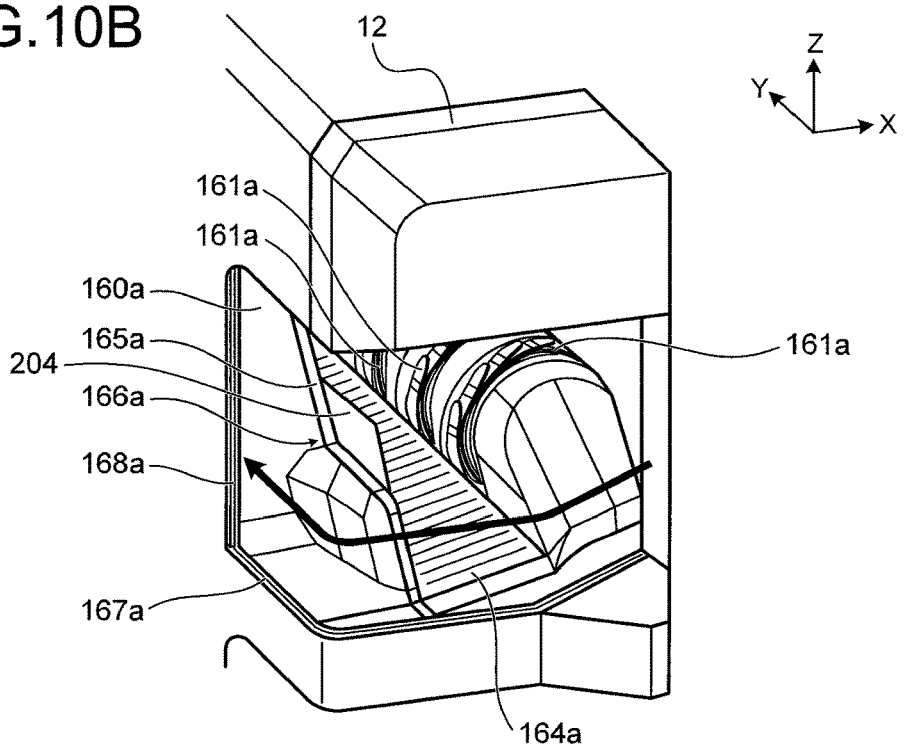

FIGS. 10A and 10B are perspective views of an example in which a shutter is arranged in the second-type stacking unit 160. In FIGS. 10A and 10B, second-type stacking unit 160*a* having a shutter is shown. However, a shutter may be similarly provided in each of the first-type stacking units 60.

As shown in FIG. 10A, typically, a bellows-type bendable shutter 168*a* is used to close the stacking unit 160*a*. The shutter 168*a* closes the opening of the stacking unit 160*a* and the cutout portion 166*a*. The control unit 90 controls the opening and closing of the shutter 168*a* by controlling a driving unit, such as a motor, arranged inside the extension module 12. For example, when taking out a banknote, the driving unit controlled by the control unit 90 moves the shutter 168*a* along a shutter groove 167*a*, as shown with an arrow in FIG. 10B. When the shutter 168*a* has been stored in the extension module 12, the cutout portion 166*a* present on the left side of the stacking unit 160*a* is apparent. As a result, an operator can grasp on both faces a banknote 204 that has been stacked with the banknote face thereof aligned to the left-side wall 165*a* of the stacking unit 160*a* and remove it.

Examples of the extension module available for use by connecting to the base module 11 of the banknote handling apparatus 1 are explained below by referring to FIGS. 11 to 15. Examples of several types of the extension modules 12 to 19 constructed in a connectable manner are explained below. Each of those extension modules includes a plurality of stacking units arranged in the vertical direction.

Figure 11:
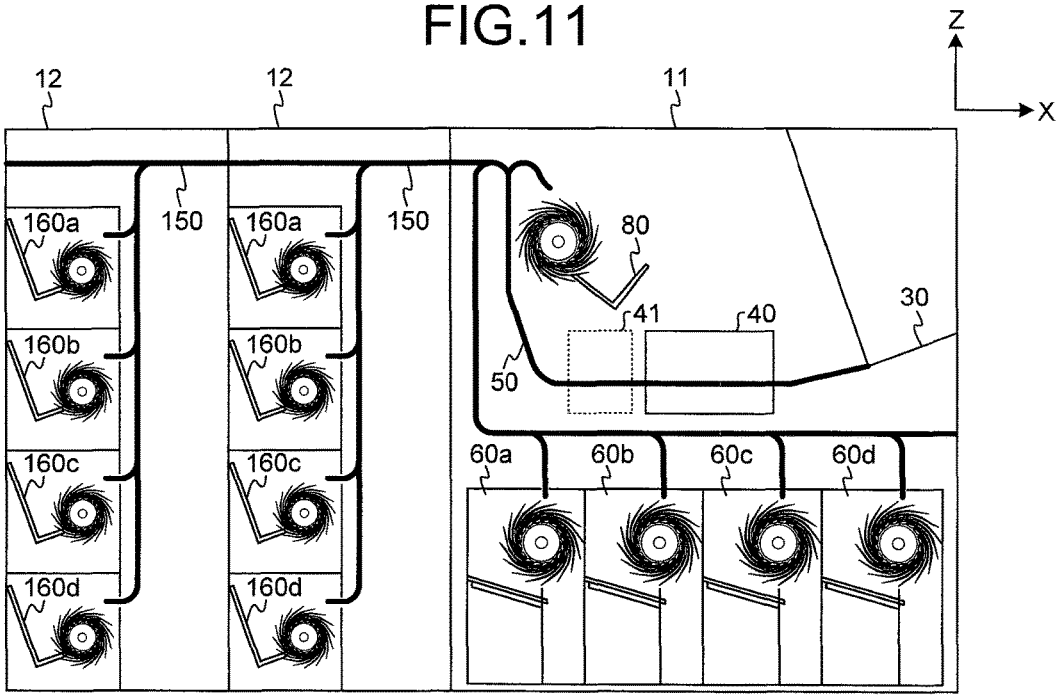
FIG. 11 is a schematic diagram indicating an example in which a plurality of extension modules are connected.

FIG. 11 is a schematic diagram indicating an example in which a plurality of extension modules 12 are connected. The second transport unit 150 of the extension module 12 transports the banknote taken from the right-side surface in the extension module 12 in the horizontal direction, and discharges the banknote from the left-side surface. As a result, as shown in FIG. 11, the plurality of the extension modules 12 can be connected and used.

Figure 12:
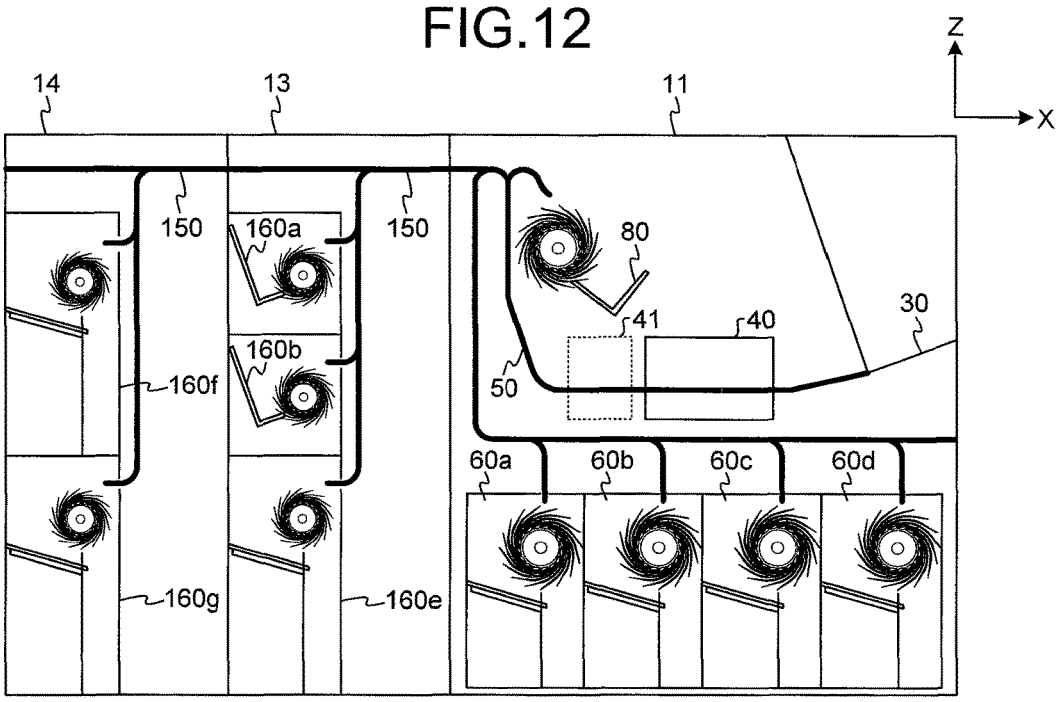
FIG. 12 is a schematic diagram indicating an example of an extension module including different types of stacking units.

FIG. 12 is a schematic diagram indicating an example of extension modules 13 and 14 including different types of stacking units 160*e* to 160*g*. The extension module 13 shown in FIG. 12 includes two stacking units 160*a* and 160*b* that stack banknotes in the inclined standing state, and one stacking unit 160*e* that stacks banknotes in a substantially horizontally stacked manner like the first-type stacking unit 60. The extension module 14 does not include a stacking unit that stacks the banknote in a standing state but includes two stacking units 160*f* and 160*g* that stack the banknotes in a substantially horizontally stacked manner. As a result, banknotes recognized by the recognition unit 40 of base module 11 can be stacked in stacking units 60*a* to 60*d* of base module 11, stacking units 160*a*, 160*b* and 160*e* of extension module 13, and stacking units 160*f* and 160*g* of extension module 14.

Figure 13:
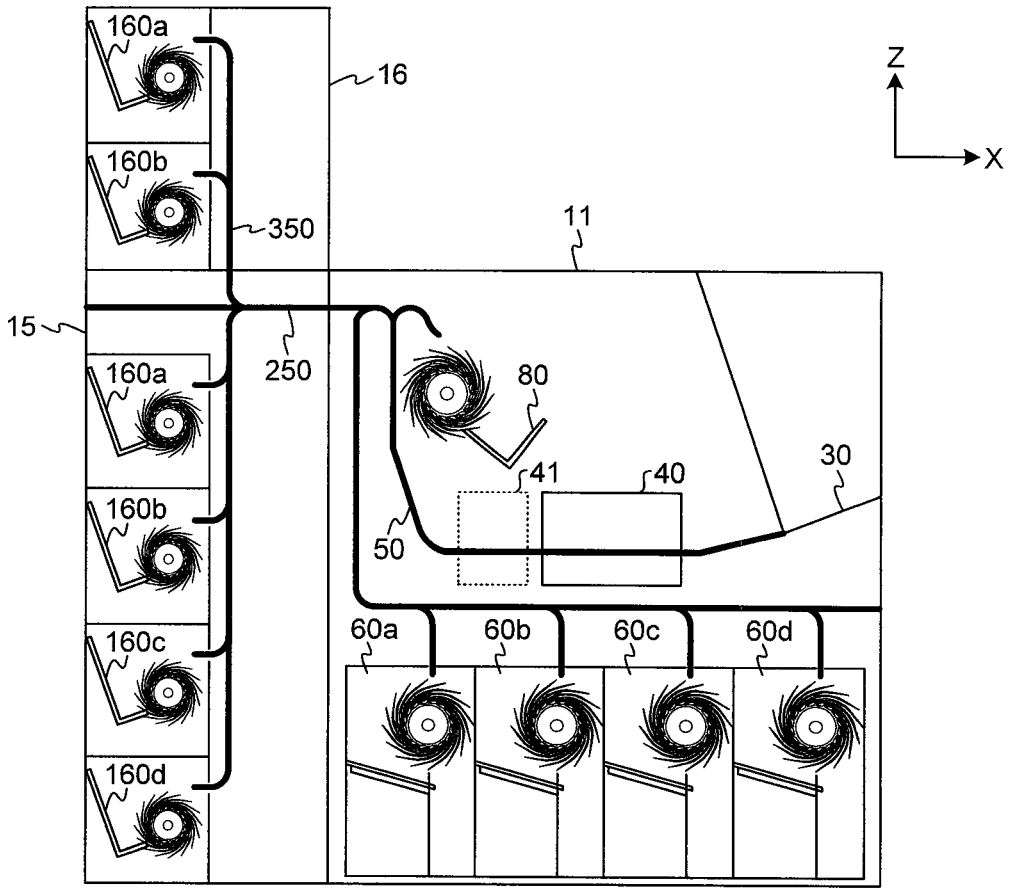
FIG. 13 is a schematic diagram indicating an example of an extension module having a top surface that can be connected to another extension module.

FIG. 13 is a schematic diagram indicating an example of an extension module 15 having a top surface that can be connected to another extension module 16. As shown in FIG. 13, the extension module 15 that is connected to the left-side surface of the base module 11 includes a transport unit 250 that can divert the banknote upward, in addition to the left direction and the lower direction, and discharge the banknote to the outside of the apparatus 11. The extension module 15 includes the four stacking units 160*a* to 160*d* for stacking the banknotes in the inclined standing state. An extension module 16 that includes a transport unit 350 to receive banknotes from a bottom surface thereof may be connected to the top surface of extension module 15. Extension module 16 includes two stacking units 160*a* and 160*b* that stack the banknotes in the inclined standing state. Transport unit 350 takes in via the bottom surface thereof the banknote that is discharged by the transport unit 250 of the lower extension module 15 via the top surface thereof. The banknote is transported to and stacked in the stacking units 160*a* and 160*b*. As a result, the banknotes recognized by the recognition unit 40 of the base module 11 can be stacked in stacking units 60*a* to 60*d* of base module 11, stacking units 160*a* to 160*d* of extension module 15, and stacking units 160*a* and 160*b* of extension module 16.

The transport units 150 and 250 of extension modules 12 to 15 take in the banknotes, which are discharged from the left-side surface of the base module 11, from the right-side surfaces of the extension modules 12 to 15, transport the banknotes in the horizontal direction, and discharge the banknotes from the left-side surface thereof. That is, each of the extension modules 12 to 15, at the same height as a height at which the banknotes were discharged from the base module 11, takes in the banknote from one side thereof and discharges the banknote from a different side thereof. As a result, several types of extension modules 12 to 15 that vary in internal structure may be operatively connected in various combinations.

Figure 14:
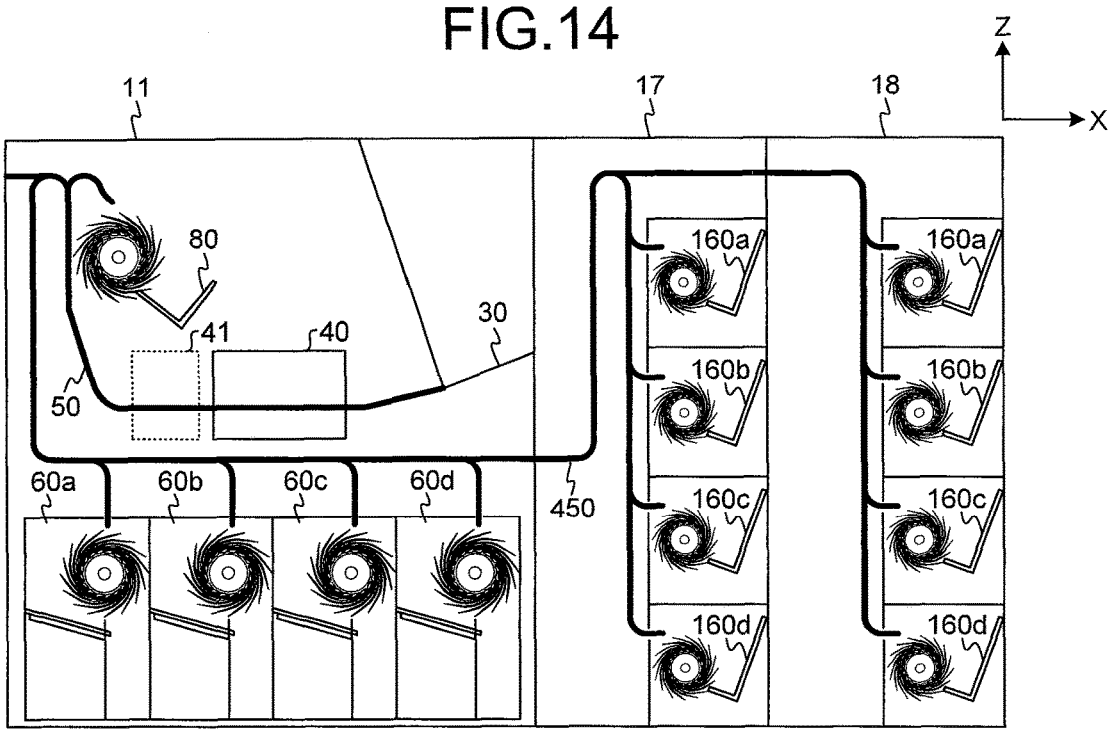
FIG. 14 is a schematic diagram indicating an example of an extension module that can be connected to a right-side surface of the base module.

FIG. 14 is a schematic diagram indicating an example of extension modules 17 and 18 that can be connected to the right-side surface of the base module 11. As shown in FIG. 14, the first transport unit 50 of the base module 11 transports the banknote, which has passed above the stacking unit 60*d* to the right direction, in the horizontal direction, and discharges the banknote from the right-side surface. Extension module 17 includes a transport unit 450 that takes in from a left-side surface thereof the banknote discharged from the right-side surface of the base module 11. When extension module 17 is connected to the right-side surface of the base module 11, the transport unit 450 of the extension module 17 either stacks the banknote, which is taken in from the base module 11, in the stacking units 160*a* to 160*d* in the inclined standing state or discharges the banknote from above the stacking unit 160*a* from a right-side surface. A height from which the extension module 17 discharges the banknote from the right-side surface thereof is the same as a height from which the base module 11 discharges the banknote from the left-side surface thereof. As a result, the extension module 18 having the same structure as the extension module 12 shown in FIG. 11 but flipped horizontally can be connected to the right-side surface of the extension module 17 as shown in FIG. 14. Similarly, the extension modules 13 and 14 shown in FIG. 12 and the extension modules 15 and 16 shown in FIG. 13 but flipped horizontally may be operatively connected to the right-side surface of the extension module 17 in various combinations.

Figure 15:
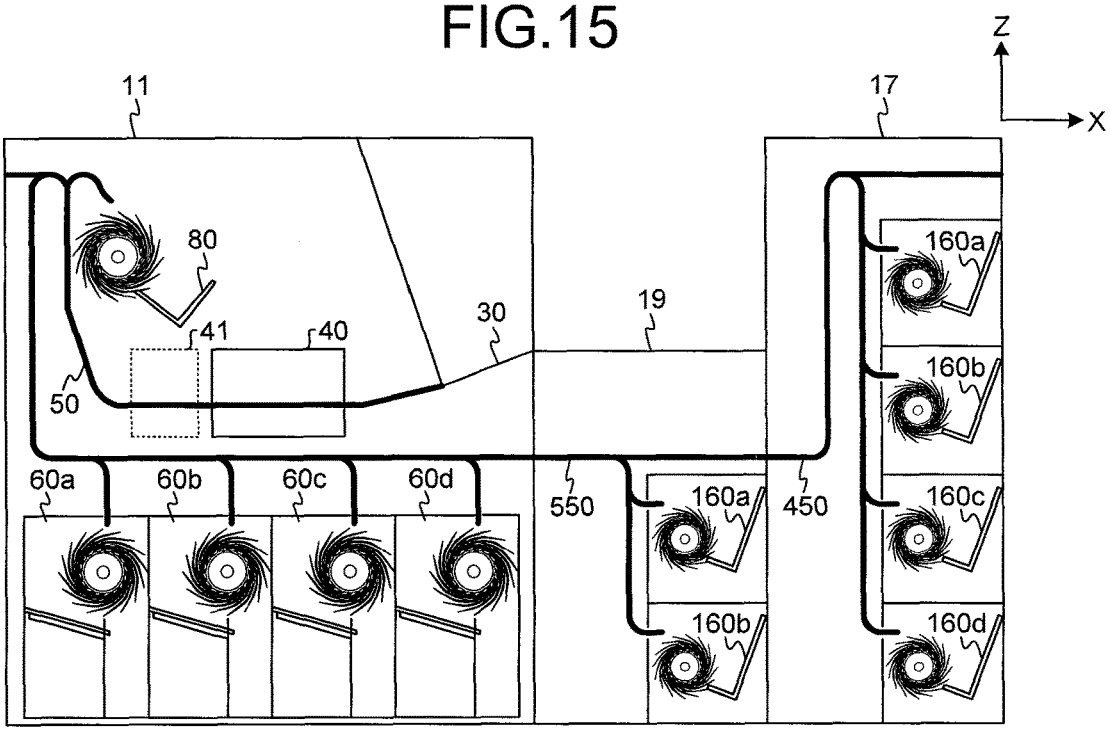
FIG. 15 is a schematic diagram indicating an example of an extension module that can be connected to the right-side surface of the base module.

FIG. 15 is a schematic diagram indicating an example of yet another extension module 19 that can be connected to the right-side surface of the base module 11. The extension module 19 shown in FIG. 15 includes two stacking units 160*a* and 160*b* that stack the banknotes in the inclined standing state, and a top surface thereof is at a lower level than a top surface of the extension module 17. Specifically, a height of the top surface of the extension module 19 is approximately the same as a height of a placement surface of the feeding unit 30 of the base module 11 on which the banknote is set. Because a space can be secured on the right side of the feeding unit 30 when the extension module 19 is connected to the right-side surface of the base module 11, the operator can easily perform the work to set the banknote on the feeding unit 30. The operator can use the top surface of the extension module 19 for temporarily storing items. Extension module 19 includes a transport unit 550 that takes in from a left-side surface thereof the banknote discharged from the right-side surface of the base module 11. When the extension module 19 is connected to the right-side surface of the base module 11, the transport unit 550 of the extension module 19 either stacks the banknote, which is taken in from the base module 11, in the stacking units 160*a* and 160*b* or transports the banknote in the horizontal direction and discharges the banknote from a right-side surface thereof. A height from which the extension module 19 discharges the banknote from the right-side surface thereof is the same as a height from which the base module 11 discharges the banknote from the right-side surface thereof. As a result, the extension module 17 shown in FIG. 14 can be connected to the right-side surface of the extension module 19 as shown in FIG. 15. Extension module 18 and the like can be connected to the right-side surface of the extension module 17 in various combinations as explained in FIG. 14.

As explained above, according to the banknote handling apparatus in the present invention, because the extension module includes a plurality of the stacking units that are arranged in the vertical direction, the installation area is reduced in comparison with a structure in which the plurality of the stacking units are arranged in the horizontal direction.

The extension module takes in from one side surface the banknote discharged by the transport unit of the base module and discharges the banknote from an opposing side. Because the several types of the extension modules have a configuration that allows taking in/sending out the banknote from/to other modules, a plurality of the extension modules may be connected in series to the base module and used for stacking banknotes.

A paper sheet handling apparatus in one embodiment of the invention includes a base module and an extension module connected to the base module. The apparatus includes a feeding unit that receives a paper sheet inside the base module; a first transport unit that transports the paper sheet fed by the feeding unit; a recognition unit that recognizes the paper sheet transported by the first transport unit; a plurality of first-type stacking units that stack paper sheets; and a control unit that controls transport of the paper sheet based on a recognition result obtained by the recognition unit. The plurality of first-type stacking units is arranged along a first direction. Each of the plurality of first-type stacking units has an opening through which a stacked banknote is taken out. The extension module includes a second transport unit that takes inside the extension module a paper sheet discharged from the base module by the first transport unit, and transports the paper sheet; and a plurality of second-type stacking units that stacks paper sheets. The plurality of second-type stacking units are arranged along a second direction that is different from the first direction. Each of the plurality of second-type stacking units has an opening from which a stacked banknote is taken out. The control unit transports the paper sheet to at least one of the first-type stacking unit and the second-type stacking unit.

In the above paper sheet handling apparatus, the first direction and the second direction are orthogonal to each other.

In the above paper sheet handling apparatus, the first direction is a horizontal direction and the second direction is a vertical direction.

In the above paper sheet handling apparatus, the first-type stacking units and the second-type stacking units are arranged in a substantially L-shaped configuration.

In the above paper sheet handling apparatus, the base module further includes a display unit arranged at a position above the plurality of first-type stacking units, and the position overlaps with a substantially central position between stacking units of both ends of the plurality of first-type stacking units.

In the above paper sheet handling apparatus, the extension module has, on a side thereof that is opposite to a side to which the base module is connected, a cutout portion from which a portion of the paper sheet stacked in the second-type stacking unit is exposed.

The above paper sheet handling apparatus further includes a second extension module that is connected to the first said extension module. The second extension module includes a third transport unit that takes inside the second extension module the paper sheet, which has been taken inside the first extension module from the base module and discharged from a surface that is different from a surface to which the base module is connected, and transports the paper sheet; and a plurality of third stacking units that stack paper sheets. The plurality of third stacking units are arranged along the second direction. Each of the plurality of third stacking unit has an opening through which a stacked paper sheet may be removed. The control unit is operable to transport the paper sheet to at least one of the plurality of first-type stacking units, the plurality of second-type stacking units, and the plurality of third stacking units.

In the above paper sheet handling apparatus, the first-type stacking unit includes a first stacking wheel that receives the paper sheet transported by the first transport unit and aligns and stacks the received banknote in the first-type stacking unit. The second-type stacking unit includes a second stacking wheel that receives the paper sheet transported by the second transport unit and aligns and stacks the received banknote in the second-type stacking unit. An external diameter of the second stacking wheel is smaller than an external diameter of the first stacking wheel.

In the above paper sheet handling apparatus, an upper edge of the opening of the first-type stacking unit has an inclined shape so that the upper surface slopes downwardly as towards the back surface of the apparatus.

In the above paper sheet handling apparatus, the first transport unit includes a first diverter arranged at a position that is downstream of the recognition unit in a transport direction. The first diverter diverts a transport direction of the paper sheet to a transport direction for discharging the paper sheet from the base module and transporting toward the extension module or a transport direction for transporting the paper sheet toward the plurality of first-type stacking unit.

In the above paper sheet handling apparatus, the second transport unit includes a second diverter that diverts a transport direction of the paper sheet taken inside the extension module from the base module. The second diverter diverts the transport direction to a transport direction for discharging the paper sheet from a surface that is different from a surface to which the base module is connected or a transport direction for transporting the paper sheet toward the second-type stacking unit.

In the above paper sheet handling apparatus, the second-type stacking unit stacks the paper sheet in a standing state in which a paper sheet surface is inclined with respect to a horizontal plane.

In the above paper sheet handling apparatus, the second-type stacking unit stacks the paper sheet in a standing state in which the paper sheet surface is inclined by 45 degrees or more with respect to the horizontal plane.

In the above paper sheet handling apparatus, an angle of inclination of the paper sheet stacked in the first-type stacking unit with respect to the horizontal plane is smaller than an angle of inclination of the paper sheet stacked in the second-type stacking unit.

In the above paper sheet handling apparatus, a maximum number of the paper sheets that can be stacked in one of the second-type stacking units is smaller than a maximum number of the paper sheets that can be stacked in one of the first-type stacking units.

In the above paper sheet handling apparatus, the maximum number of the paper sheets that can be stacked in one of the second-type stacking units is equal to a divisor of the maximum number of the paper sheets that can be stacked in one of the first-type stacking units.

In the above paper sheet handling apparatus, the maximum number of paper sheets that can be stacked in one of the second-type stacking units is one fourth of the maximum number of the paper sheets that can be stacked in one of the first-type stacking units.

In the above paper sheet handling apparatus, the extension module includes four second-type stacking units.

In the above paper sheet handling apparatus, a maximum number of the paper sheets that can be stacked in the extension module is equal to the maximum number of the paper sheets that can be stacked in one of the first-type stacking units, and the control unit considers the extension module to be one of the first-type stacking unit and controls transport of the paper sheet accordingly.

In the above paper sheet handling apparatus, the first transport unit includes a vertical transport unit that transports the paper sheet to a direction that is substantially perpendicular to the horizontal plane. The base module further includes a reject unit that stacks a rejected banknote. The reject unit is arranged on a side that is opposite of a side to which the extension module is connected with respect to the vertical transport unit.

In the above paper sheet handling apparatus, a housing of the base module includes a substantially horizontal planar surface located between the feeding unit and the reject unit.

According to the present invention, the paper sheet handling apparatus can sort and stack the paper sheets by using a plurality of first-type stacking units in the base module and a plurality of the second-type stacking units in the extension module. The second-type stacking units are arranged in the vertical direction whereas the first-type stacking units are arranged in the horizontal direction. As a result, the installation area of the paper sheet handling apparatus is reduced in comparison with a structure in which all the stacking units are arranged in the horizontal direction. Moreover, because the distance between the stacking units on both ends is relatively small, it is easy for the user of the paper sheet handling apparatus to visually check whether a paper sheet is stacked in any of the stacking units. Thus, the paper sheet handling apparatus is easy for the user to use.

As explained above, the paper sheet handling apparatus according to the present invention has a large number of stacking units, but it requires a smaller installation area, and it is easy to use.

Although the invention has been explained with respect to specific embodiments for a complete and clear disclosure, the appended claims are not to be thus limited but are to be construed as embodying all modifications and alternative constructions that may occur to one skilled in the art that fairly fall within the basic teaching of the claims.

What is claimed is:

1. A paper sheet handling apparatus comprising:

a base module; and an extension module connected to the base module, wherein the base module comprises a feeding unit that receives a paper sheet inside the base module;

a first transport unit that transports the paper sheet fed by the feeding unit;

a recognition unit that recognizes the paper sheet transported by the first transport unit;

a plurality of first stacking units that stack paper sheets, the plurality of first stacking units being arranged along a first direction and each having an opening through which a stacked paper sheet is removable; and a control unit that controls transport of the paper sheet based on a recognition result obtained by the recognition unit, and the extension module comprises a second transport unit that receives the paper sheet discharged from the base module by the first transport unit, and transports the paper sheet; and a plurality of second stacking units that stack paper sheets, the plurality of second stacking units being arranged along a second direction that is orthogonal to the first direction and each having an opening through which a stacked paper sheet is removable, wherein the control unit controls the first transport unit and the second transport unit to transport the paper sheet to at least one of the plurality of first stacking units and the plurality of second stacking units.

2. The paper sheet handling apparatus as claimed in claim 1, wherein the first direction is a horizontal direction and the second direction is a vertical direction.

3. The paper sheet handling apparatus as claimed in claim 2, wherein the base module further comprises a display unit arranged at a position above the plurality of first stacking units, and the position overlaps with a substantially central position between stacking units at both ends of the plurality of first stacking units.

4. The paper sheet handling apparatus as claimed in claim 1, wherein the extension module has, on a side that is opposite of a side to which the base module is connected, a cutout portion through which a portion of the paper sheet stacked in a second stacking unit is exposed.

5. The paper sheet handling apparatus as claimed in claim 1, the extension module is a first extension module, and further comprising a second extension module that is connected to the first extension module, wherein the second extension module comprises a third transport unit that receives the paper sheet, which has been received inside the first extension module from the base module and discharged from a surface that is different from a surface to which the base module is connected, and transports the paper sheet; and a plurality of third stacking units that stack paper sheets, the plurality of third stacking units being arranged along the second direction and each having an opening through which a stacked paper sheet is removable, and the control unit controls the first transport unit, the second transport unit and the third transport unit to transport the paper sheet to at least one of the plurality of first stacking units, the plurality of second stacking units, and the plurality of third stacking units.

6. The paper sheet handling apparatus as claimed in claim 1, wherein each of the plurality of first stacking units comprises a first stacking wheel that receives the paper sheet transported by the first transport unit and aligns and stacks a received banknote therein, each of the plurality of second stacking units comprising a second stacking wheel that receives the paper sheet transported by the second transport unit and aligns and stacks a received banknote therein, and wherein an external diameter of the second stacking wheel being less than an external diameter of the first stacking wheel.

7. The paper sheet handling apparatus as claimed in claim 1, wherein an upper part of the opening of each of the plurality of first stacking units slopes downwardly from a front surface of the apparatus towards a back surface thereof.

8. The paper sheet handling apparatus as claimed in claim 1, wherein the first transport unit comprises a first diverter arranged at a position that is downstream of the recognition unit in a transport direction, and the first diverter diverts a transport direction of the paper sheet to a transport direction for discharging the paper sheet from the base module and onward toward the extension module or to a transport direction for transporting the paper sheet toward the plurality of first stacking units.

9. The paper sheet handling apparatus as claimed in claim 8, wherein the second transport unit comprises a second diverter that diverts a transport direction of the paper sheet taken inside the extension module from the base module, and the second diverter diverts the transport direction to a transport direction for discharging the paper sheet from a surface that is different from a surface to which the base module is connected or to a transport direction for transporting the paper sheet toward the second stacking units.

10. The paper sheet handling apparatus as claimed in claim 1, wherein each of the plurality of second stacking units stacks the paper sheet in a standing state in which a paper sheet surface is inclined with respect to a horizontal plane.

11. The paper sheet handling apparatus as claimed in claim 10, wherein each of the plurality of second stacking units stacks the paper sheet in the standing state in which the paper sheet surface is inclined by 45 degrees or more with respect to the horizontal plane.

12. The paper sheet handling apparatus as claimed in claim 11, wherein an angle of inclination of the paper sheet stacked in each of the plurality of first stacking units with respect to the horizontal plane is less than an angle of inclination of the paper sheet stacked in each of the plurality of second stacking units.

13. The paper sheet handling apparatus as claimed in claim 1, wherein a maximum number of paper sheets that can be stacked in each of the plurality of second stacking units is smaller than a maximum number of the paper sheets that can be stacked in each of the plurality of first stacking units.

14. The paper sheet handling apparatus as claimed in claim 13, wherein the maximum number of the paper sheets that can be stacked in each of the plurality of second stacking units is equal to a divisor of the maximum number of the paper sheets that can be stacked in each of the plurality of first stacking units.

15. The paper sheet handling apparatus as claimed in claim 13, wherein the maximum number of the paper sheets that can be stacked in each of the plurality of second stacking units is one fourth of the maximum number of the paper sheets that can be stacked in each of the plurality of first stacking units.

16. The paper sheet handling apparatus as claimed in claim 15, wherein the extension module comprises four second stacking units.

17. The paper sheet handling apparatus as claimed in claim 13, wherein a maximum number of the paper sheets that can be stacked in the extension module is equal to the maximum number of the paper sheets that can be stacked in each of the plurality of first stacking units, and the control unit controls the first transport unit and the second transport unit to transport the paper sheets to all of the first stacking units and the second stacking units.

18. The paper sheet handling apparatus as claimed in claim 1, wherein the base module further includes a reject unit that stacks a reject banknote, and wherein, the reject unit is arranged upstream both the plurality of first stacking units and the plurality of second stacking units along a transport direction of the paper sheet.

19. The paper sheet handling apparatus as claimed in claim 18, wherein a housing of the base module includes a substantially horizontal planar surface located between the feeding unit and the reject unit.

* * * * *